US010774833B2

(12) United States Patent
Bush

(10) Patent No.: US 10,774,833 B2
(45) Date of Patent: Sep. 15, 2020

(54) SCROLL-TYPE MACHINE

(71) Applicant: James William Bush, Skaneateles, NY (US)

(72) Inventor: James William Bush, Skaneateles, NY (US)

( * ) Notice: Subject to any disclaimer, the term of this patent is extended or adjusted under 35 U.S.C. 154(b) by 413 days.

(21) Appl. No.: 15/862,786

(22) Filed: Jan. 5, 2018

(65) Prior Publication Data

US 2019/0211820 A1 Jul. 11, 2019

Related U.S. Application Data

(60) Provisional application No. 62/444,962, filed on Jan. 11, 2017.

(51) Int. Cl.

| | |
|---|---|
| ***F04C 18/02*** | (2006.01) |
| ***F01C 1/02*** | (2006.01) |
| ***F01C 17/06*** | (2006.01) |
| ***F04C 15/00*** | (2006.01) |
| ***F04C 2/02*** | (2006.01) |

(Continued)

(52) U.S. Cl.

CPC ..... *F04C 18/0215* (2013.01); *F01C 1/0215* (2013.01); *F01C 17/066* (2013.01); *F01C 21/10* (2013.01); *F04C 2/02* (2013.01); *F04C 15/0065* (2013.01); *F04C 18/0292* (2013.01); *F04C 23/008* (2013.01); *F04C 2240/30* (2013.01); *F04C 2240/50* (2013.01); *F04C 2240/60* (2013.01); *F04C 2240/807* (2013.01)

(58) Field of Classification Search

CPC ..... F04C 15/0065; F04C 18/0215; F04C 18/0292; F04C 2240/50; F04C 2240/807; F01C 1/0215; F01C 17/066

See application file for complete search history.

(56) References Cited

U.S. PATENT DOCUMENTS 3,884,599 A 5/1975 Young et al.
5,152,682 A 10/1992 Morozumi et al.

(Continued)

FOREIGN PATENT DOCUMENTS

EP 085124 A1 7/1998

*Primary Examiner* — Ryan A Reis

(74) *Attorney, Agent, or Firm* — Bernhard P. Molldrem, Jr.

(57) ABSTRACT

A scroll-type displacement machine, e.g. scroll compressor, has fixed and orbiting scrolls and an Oldham ring to prevent relative rotation between scrolls. A drive module positioned between the orbiting scroll and drive shaft incorporates an eccentric drive system and first and second counterweights for dynamic balancing. The motor, motor bearings, and motor shaft (i.e., drive shaft) are packaged as a separate, modular unit (e.g. "off-the-shelf" motor) that attaches to the compressor frame. The machine is configured as a high-side machine with a low-pressure port at a radial outer portion of the fixed scroll and a high-pressure port or discharge port located in the floor of the orbiting scroll at its axis, with high pressure flow passing over and around the eccentric drive bearing and drive mechanism. The Oldham ring is distributed on a lateral or radial plane of the scroll pair with a portion surrounding a portion of the fixed scroll and another portion surrounding a portion of the orbiting scroll. The ring may be formed as four arcuate members arranged on two levels, to occupy otherwise unused space in the scroll-type machine.

29 Claims, 19 Drawing Sheets

(51) Int. Cl.
*F01C 21/10* (2006.01)
*F04C 23/00* (2006.01)

(56) References Cited

U.S. PATENT DOCUMENTS

| | | | | |
|---|---|---|---|---|
| 5,370,513 | A * | 12/1994 | Fain | F04C 18/0215 418/151 |
| 5,775,893 | A * | 7/1998 | Takao | F04C 18/0223 418/55.2 |
| 6,158,989 | A | 12/2000 | Barito | |
| 6,264,443 | B1 | 7/2001 | Barito | |
| 6,499,977 | B2 | 12/2002 | Barito et al. | |
| 2004/0101428 | A1* | 5/2004 | Shibamoto | F04C 18/0269 418/55.2 |
| 2007/0183915 | A1* | 8/2007 | Guo | F04C 18/0215 418/55.6 |
| 2011/0158839 | A1 | 6/2011 | Higashiyama et al. | |
| 2014/0024563 | A1* | 1/2014 | Heidecker | F04C 29/02 508/106 |
| 2015/0044082 | A1* | 2/2015 | Kiem | F04C 18/0215 418/55.2 |
| 2015/0101428 | A1 | 2/2015 | Kiem et al. | |
| 2017/0306960 | A1* | 10/2017 | Pax | F04C 27/005 |

* cited by examiner

SCROLL-TYPE MACHINE

This Application claims priority of U.S. Provisional Application No. 60/444,962, Jan. 11, 2017.

This invention was made with government support under DE-AR0000562 awarded by DOE. The government may have certain rights in this invention.

FIELD OF THE INVENTION

The present invention generally relates to scroll-type displacement machines adapted as a compressor, expander (pneumatic motor), liquid pump, or hydraulic motor. More particularly, according to one aspect, the present invention relates to a so-called high-side machine, where the compressor mechanism within the casing is surrounded by high-pressure working fluid. According to another aspect, the present invention relates to a unique arrangement of the internal drive system which simplifies the manufacture of the scroll-type machine and which allows for easy adaptation to various motor types (ie. compressor or pump) or various power transfer devices (i.e. expander or motor). According to a further aspect, the present invention relates to such a machine which uses an Oldham coupling (or ring) to prevent rotation of the orbiting scroll relative to the fixed scroll. According to yet another aspect, the present invention relates to hermetic or semi-hermetic compressors where the motor and compressor are sealed within an enclosure which contains the working fluid to be compressed.

BACKGROUND OF THE INVENTION

Scroll-type displacement machines are commonly employed as a compressor for various gases, including air and refrigerants. However, they are readily adapted for use as a compressed vapor expander (e.g. pneumatic motor), a liquid pump, or a hydraulic motor. In normal operation, scroll-type machines have high pressure in the center region of the scroll pair and low pressure around the outside periphery. Fluid flows from the outside to the inside for compressors and pumps and from the inside to the outside for expanders and motors.

In the case of so-called low-side machines, where the housing containing the scroll mechanism contains working fluid at the low-pressure level, means are provided to isolate the high pressure fluid passing through the high pressure port in the fixed scroll, sometimes through a simple discharge tube attached to the fixed scroll and more commonly through a high pressure manifold or pulse volume integrated into the external housing and further communicating externally through a high-pressure tube or fitting.

For so-called high-side machines the low-pressure flow is connected directly to the scroll pair at the periphery and the high-pressure flow exits at the center of the scroll pair and passes through an external housing which contains the pressurized flow. The high pressure flow serves to cool the bearings and any other heat-generating components such as motors or sliding mechanisms. The orbiting scroll typically has a drive bearing located at the center of the scroll on the opposite side from the spiral vanes. In order to isolate this drive system from the direct fluid flow, the high pressure port is typically located at the center of the fixed scroll, on the opposite side of the scroll set from the drive bearing. The high-pressure port in the fixed scroll communicates directly with the interior of the external housing. In such an arrangement means are provided for flow to pass around the scroll set to communicate between the discharge port on one side of the scroll set and the rest of the external housing on the other side. This may take the form of an enlarged external housing or special gas passage means to carry the fluid. These options represent some degree of increased size and weight for the overall compressor assembly along with associated complications in manufacture.

Accordingly, an aspect of the invention is directed towards improvements over the state of the art as it relates to routing high pressure fluid in a high-side machine to avoid the disadvantages associated with conducting high pressure working fluid between a fixed scroll high pressure port and the external compressor housing.

In all these configurations a drive shaft, used either to input or to extract mechanical power, is provided with support bearing means to support radial loads and to allow free rotation of the drive shaft. Interposed between the drive shaft and the orbiting scroll is an eccentric drive bearing which may take the form of an eccentric bearing, a so-called slider block, or an eccentric bushing, all serving to provide an eccentric drive to connect between the drive shaft and the orbiting scroll and to drive the orbiting scroll in a circular path, i.e., a circular non-rotating orbit. The eccentric drive bearing may take the form of a bearing rigidly attached to the drive shaft and which drives the orbiting scroll through a fixed orbital radius or it may take the form of a so-called radially compliant drive where the radial position of the orbiting scroll relative to the drive shaft center is permitted to vary in response to misalignment and tolerance variations so as to maintain positive contact at all times between the vane walls of the orbiting scroll and the fixed scroll.

Additionally, a counterweight arrangement is provided to achieve a dynamic balance among the various orbiting, rotating, and translating masses within the machine. Typically, a primary counterweight nearest the orbiting scroll provides a static balance for the machine. However, the axial spacing between the planes of unbalance of the moving components and the plane of action of the primary counterweight results in an overturning moment which tends to impose a wobbling-type load onto the shaft and consequently onto compressor frame which results in undesirable vibration. To counteract this dynamic unbalance, a secondary counterweight is provided toward the end of the shaft opposite the orbiting scroll (on the other side of said primary counterweight) to create a counteracting overturning moment. An equivalent mass unbalance may also be added to the primary counterweight to maintain static balance. In a way, the scroll-type machine may be said to have three counterweights: one larger counterweight to provide a static balance and two smaller counterweights of identical unbalance phased 180 degrees from each other and axially separated to provide a dynamic balance with one of the smaller counterweights at the same location as the larger counterweight. The primary counterweight may thus consist of the combination of the larger counterweight and one of the smaller counterweights while the secondary counterweight is simply the other smaller counterweight.

The offset between the drive shaft center and the center of said eccentric drive bearing defines an angular reference which rotationally orients the drive shaft. The moving masses within the machine may all be defined by their axial position along the axis of the drive shaft and by their angular orientation relative to the eccentric drive bearing angular reference. Likewise, the locations of the primary counterweight and the secondary counterweight are also defined by axial positions along the drive shaft axis and their angular positions relative to the eccentric drive bearing angular reference. The mass unbalances of these counterweights are chosen to counter the mass unbalances of all the moving masses.

In typical scroll machines, the drive means, the primary counterweight, and the secondary counterweight are all separate components located at separate axial locations along the drive shaft. Typically the primary counterweight is interposed between the support bearing and the drive means and said secondary counterweight is placed at the opposite end of the drive shaft. During manufacture, locating means must be provided to position these counterweights properly both axially and angularly onto the drive shaft. Such locating means may consist of locating features between the counterweights and the drive shaft, they may consist of external fixturing, or they may consist of a combination of locating features and fixturing. This construction requires fabrication, alignment, and assembly of a number of components during manufacture of the scroll machine, all of which adds to the cost of manufacture. In some designs, the drive shaft and primary counterweight may be combined into a single component but with the same general overall layout.

The support bearing means typically includes two bearings supporting the main drive shaft which are in turn supported by a structure, frame or shell. In scroll-type machines where a motor (for compressors or pumps) or a power transfer device (e.g. a generator for expanders or hydraulic motors) is integrated into the scroll-type machine, the motor or power transfer device is supported by the structure or frame and is located between the two bearings or just outboard of the two bearings. The rotor component of the motor or power transfer device is affixed onto the drive-shaft. The result of such close integration is that drive shaft, counterweights, and structure or frame are to a large extent custom designed for a single motor or power transfer device. This has advantages in reducing material content in high volume production of larger machinery but is relatively inflexible or difficult to change if variations in the design of motor or power transfer device are desired.

One requirement for proper operation for scroll-type machines is that the two scrolls must be constrained from any relative rotation between them. The orbiting scroll follows a circular path or orbit with respect to the fixed scroll but relative rotation is not permitted. In some designs, both scrolls are adapted to rotate together on offset axes (as opposed to the conventional fixed-orbiting arrangement) but they both rotate at the same speed and the angular phasing between the two scrolls remains the same, which is to say they do not rotate relative to one another.

Several different mechanisms may be used to prevent the relative rotation between the two scrolls, but an Oldham coupling (comprising an Oldham ring and mating features on the two respective scrolls) is in common use today. A typical Oldham ring comprises a solid body, more or less ring-shaped. The body may be an oblong or irregular shape to fit around other features in the machine but it will generally follow the pattern of a closed ring. Axial or radial projections from the Oldham ring body are provided with axially extending surfaces or keyways which engage matching surfaces on the respective scrolls to complete the coupling assembly and to prevent relative rotation between the scrolls while permitting orbiting action.

The ring-shaped portion of the Oldham ring is typically flat and of a more or less uniform thickness, being generally distributed about a radial plane at all points around the ring. A radial plane which passes through the centroid of the Oldham ring will divide the Oldham ring into two continuous ring-shaped portions. Thus the main body of the Oldham ring will have a space set aside specifically to contain it and allow free motion during operation. This dedicated space adds to the overall height (i.e. axial length) of the scroll-type machine and thereby increases the size and weight of the scroll machine.

Thus an aspect of this invention is directed towards improvements over the state of the art as it relates to the design of an Oldham coupling to avoid the need for a dedicated axial space for the coupling and thereby to reduce the overall size of the displacement machine.

In some applications where the working fluid (vapor) must be isolated from the outside air (such as in a refrigeration circuit) the compressor and drive motor are contained within a sealed housing which isolates the working fluid from the outside environment. The vapor flows around the compressor and motor and provides cooling, especially for the motor.

The drive motor, typically an electric motor, is normally integrated into the overall compressor assembly. The motor stator is integrated into the compressor frame and the motor rotor is mounted directly onto the compressor shaft, which also incorporates the compressor drive means (e.g. eccentric bearing) and counterweights which may be placed on both sides of the motor or even attached directly to the rotor. This arrangement provides acceptable economy and simplicity by minimizing the number of separate components that make up the motor and compressor combination. However, a given compressor is then dedicated to a particular motor size and design. Physical changes to the motor often require extensive changes to the compressor frame and drive shaft to accommodate the new motor.

In larger compressors the motor lineup is typically standardized with common motor sizes and configurations found across a relatively limited selection of motor suppliers. There is seldom a need to change to a different size motor and the compressor design can be relatively stable with regard to motor selection.

But in smaller compressors, there is a very wide variety of motor types and manufacturers to choose from. These motors are normally available as prepackaged modules with motor housing, shaft, and bearings integrated together into a single product intended for a wide array of applications, a small scroll compressor being only one of them.

So another aspect of this invention is directed towards a general compressor design which allows use of a range of prepackaged motors of various sizes with minimal if any changes to the compressor or to the motor.

OBJECTS AND SUMMARY OF THE INVENTION

Accordingly, it is an object of this invention to locate the high-pressure port in a high-side scroll-type machine at the center of the orbiting scroll. The inlet or low pressure port may then be located in a radially outer portion of the fixed scroll which may have a solid baseplate thus avoiding any need to provide means for fluid communication between the fixed scroll and the compressor housing (which is at high pressure).

It is a related object greatly to simplify the structure around the scroll set and in some cases to provide the option of the fixed scroll itself forming an exterior end wall of the compressor housing.

In an embodiment of this invention, high-pressure fluid passes directly from the center of the orbiting scroll over the drive bearing means that engages the orbiting scroll and thus through a path directly between the high pressure port and the interior of the compressor housing. Lubricant which is entrained in the vapor flow serves to lubricate the drive bearing means and other mechanical components in the displacement machine. This arrangement is well to systems where the fluid flow is contained within a closed loop and a fixed quantity of recirculating lubricant is present. However, this may be easily adapted to open-cycle systems, where the fluid passes through the displacement machine once and does not recirculate, by providing means to inject lubricant into the inlet flow and optionally to extract it from the outlet flow.

As a result, the high-side scroll machine is simpler, more compact, and easier to manufacture than an equivalent high side machine with the high pressure port at the center of the fixed scroll.

In accordance with another aspect of the present invention, the scroll machine combines the eccentric drive bearing means, the primary counterweight, and the secondary counterweight into a single component or module (referred to in the description as a widget) which may be affixed to the end of the drive shaft adjacent the orbiting scroll. This module is designed as a single, unitary piece suitable for casting, molding, forming, or machining operations so that the necessary counterweight sizes and locations relative to said eccentric drive bearing means are integral to the as-formed part and no subassembly, alignment operations, or alignment features are required. Since all angular relationships are built into the drive module there is no need for angular alignment of the drive module with the drive shaft. The module or widget is preferably designed to be fitted on to the end of a drive shaft although the module could also be formed integrally with the drive shaft.

According to another aspect of this invention, the drive module may be standardized in terms of the interface with the motor or the power transfer device so that a wide variety of motors or power transfer devices may be readily adapted to a particular scroll machine model.

The drive shaft and shaft support bearing means may be packaged as part of the motor or power transfer device assembly. This allows ready access to a wide range of commercially produced motors or other drive devices with no significant design change required to integrate a variety of different devices into a scroll-type machine. Only details of device attachment, alignment, and the attachment of the drive module to the drive shaft need be considered. The rated bearing life of said device when applied to the scroll machine would simply be one of the product specifications along with other performance specifications.

A still further aspect of the present invention is to improve the Oldham coupling for the scroll machine. In an embodiment of this invention, the main body of the Oldham ring may be considered as being divided into four arc-shaped segments. A first pair of diametrically opposed segments bridges between and slidingly engages with the corresponding Oldham coupling surfaces on the orbiting scroll. The first segment pair occupies around the same level, i.e. the same axial position, as the orbiting scroll baseplate but not extending beyond the orbiting scroll floor surface. The space between the ends of the segment pairs is occupied by the Oldham key tabs on the orbiting scroll. The first segment pair occupies otherwise unused space in the machine. The second pair of diametrically opposed segments (oriented generally at 90 degrees to the first pair) bridges between and slidingly engages with the corresponding Oldham coupling surfaces on the fixed scroll. The second segment pair occupies a level starting at around the floor of the orbiting scroll baseplate (also the fixed scroll tip surface) and extends away from the orbiting scroll floor but does not extend across the plane defined by the orbiting scroll floor. This makes the coupling arrangement more compact. The symmetry of the Oldham ring of this design eliminates any polarity or handedness, so that it is impossible to install improperly.

The ends of the segment pairs can favorably be extended so that they overlap some reasonable distance in a common radial or lateral plane. With the segment pairs fused together at the overlap zones, the Oldham ring becomes a single solid object which may be fabricated by a number of methods.

No particular axial space specifically needs to be provided to house the Oldham ring. The spaces it inhabits, with the first segment pair extending between the key tabs of the orbiting scroll and with the second segment pair bridging over the key tabs, is space already present in the compressor layout and otherwise unused. There is no need to provide clear space along a single axial plane such as is required to house the conventional flat ring of prior-art Oldham couplings. A still further aspect of the present invention is to design the scroll machine to permit incorporation of a prepackaged motor unit including stator, rotor, housing, bearings, and shaft, as is typical of commercially available motors. The motor unit can be attached to the compressor frame and a drive module may then be attached to the end of the motor shaft. The motor shaft and bearings serve as the main compressor shaft and bearings. Design changes, if any, accompanying a motor change are limited to details of the motor unit attachment to the compressor frame, and of the drive module attachment to the motor shaft.

Other aspects, objectives and advantages of the invention are disclosed in the following detailed description, the appended claims, and the accompanying figures.

DETAILED DESCRIPTION OF THE PREFERRED EMBODIMENT(S)

Figure 1:
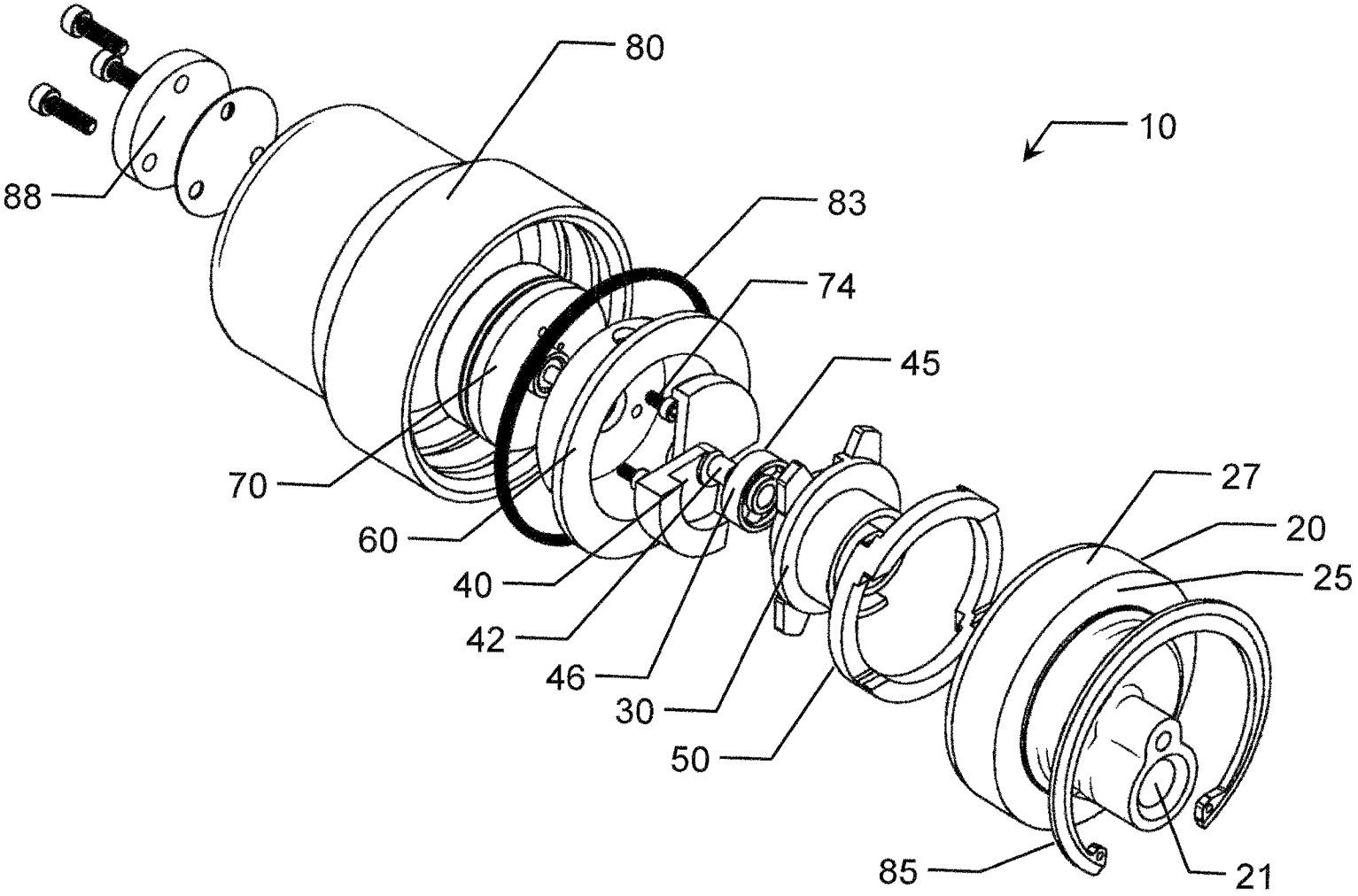
FIG. 1 is an exploded isometric view of a scroll-type machine, here a compressor according to one embodiment of this invention, viewed from the scroll end.
Figure 2:
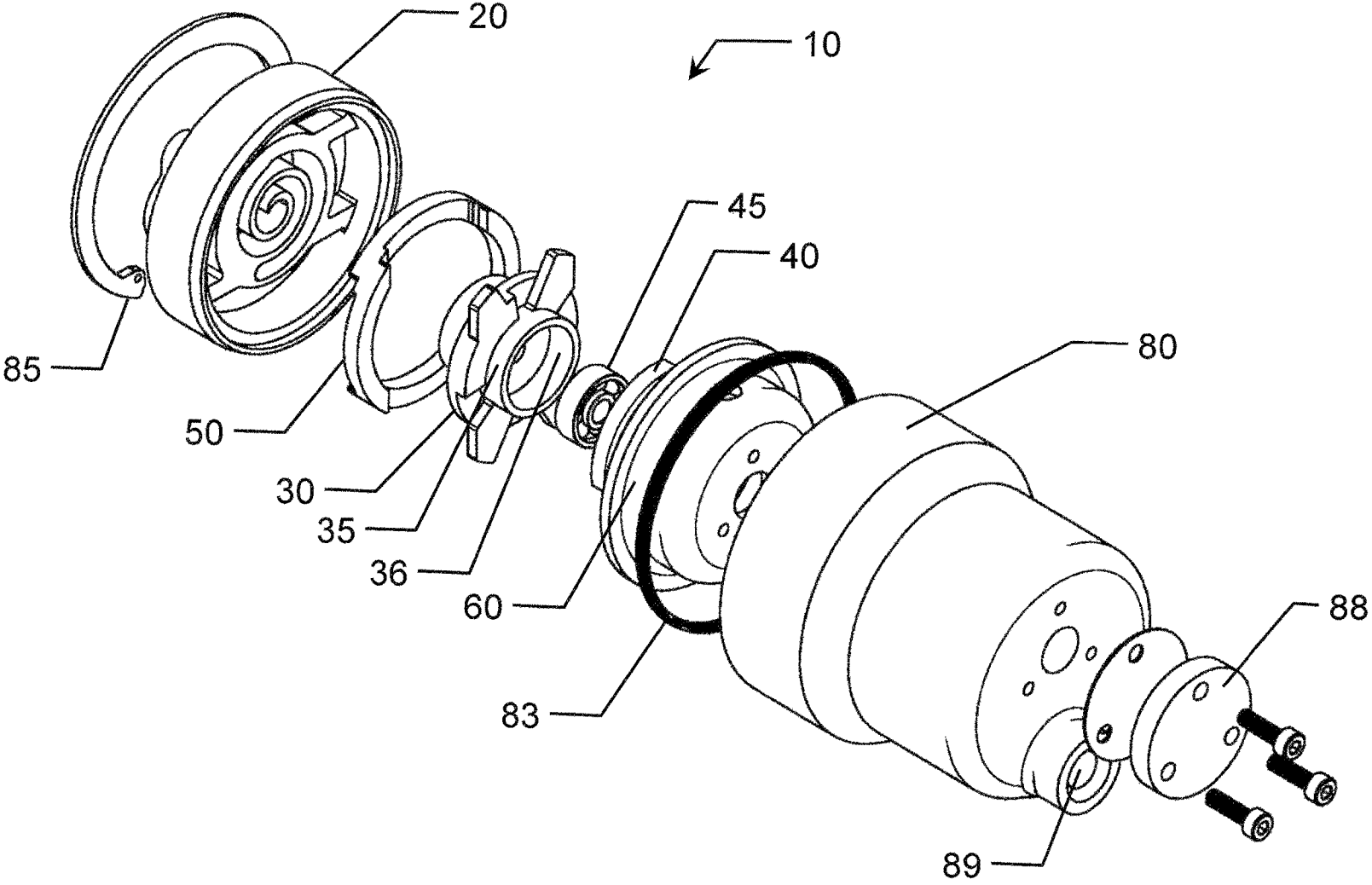
FIG. 2 is an exploded isometric view of the same compressor viewed from the motor end.
Figure 3:
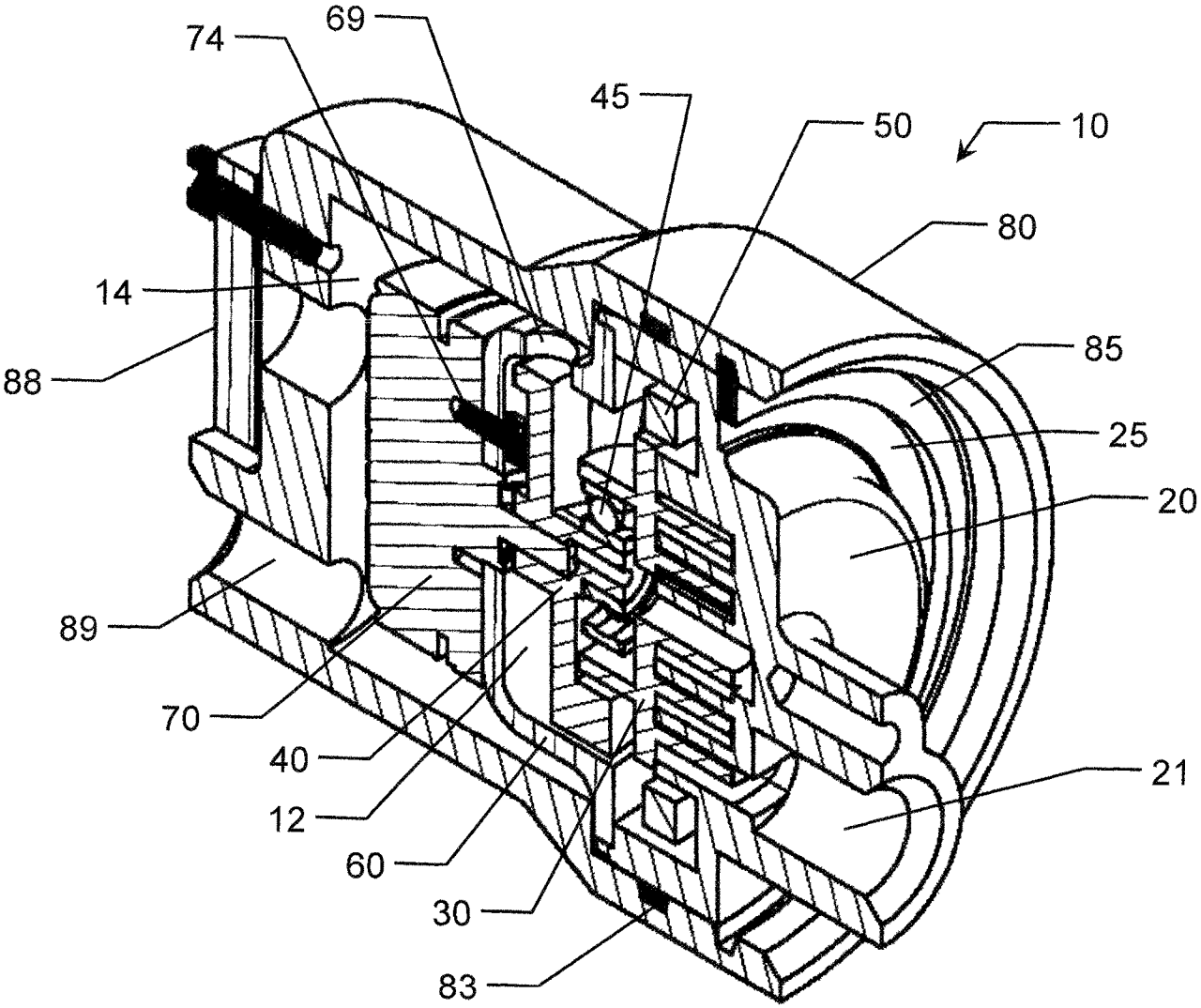
FIG. 3 depicts a cross-sectional isometric view of the same compressor.
Figure 4:
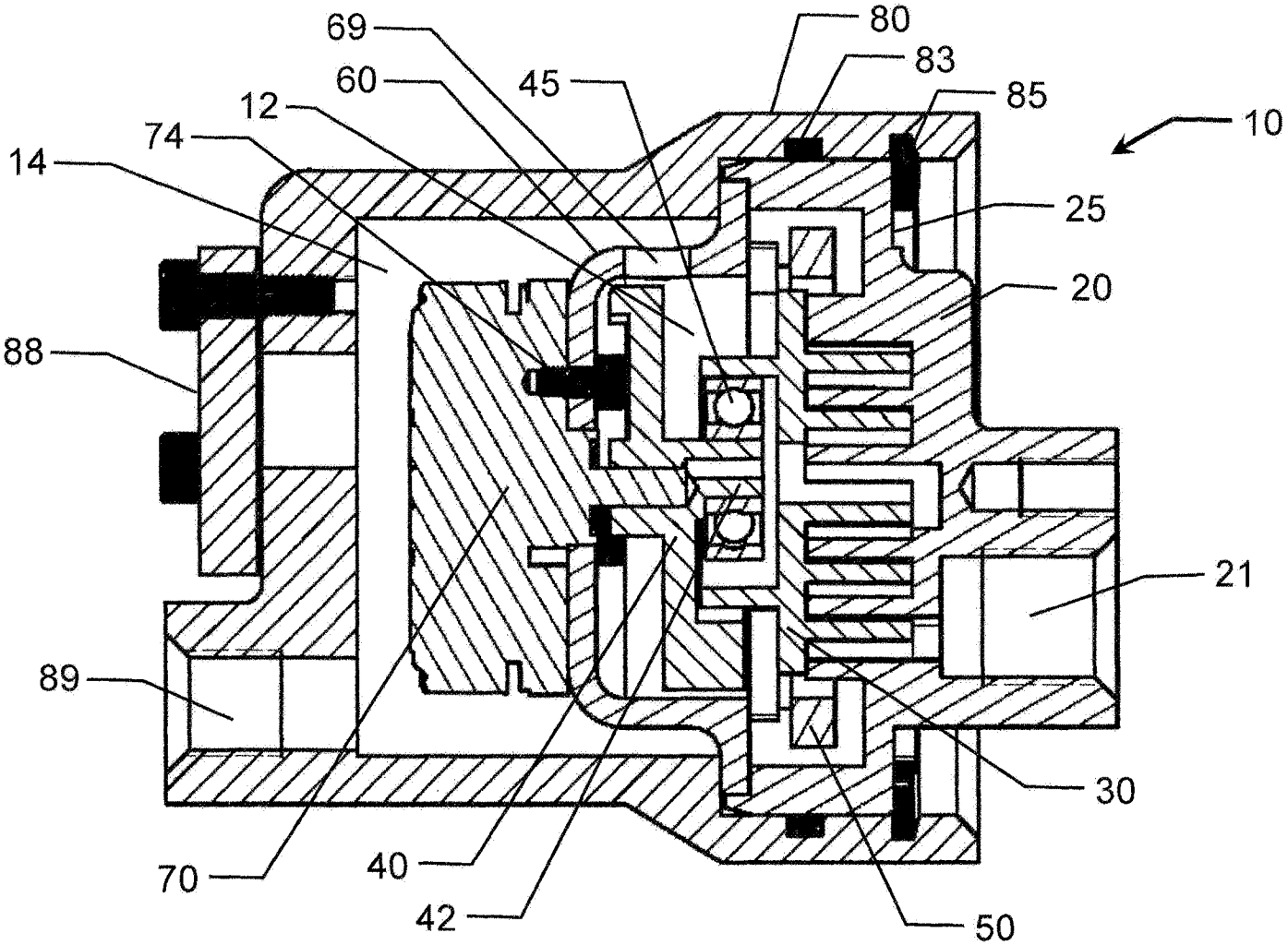
FIG. 4 depicts a cross-sectional orthographic view of the same compressor.
Figure 5:
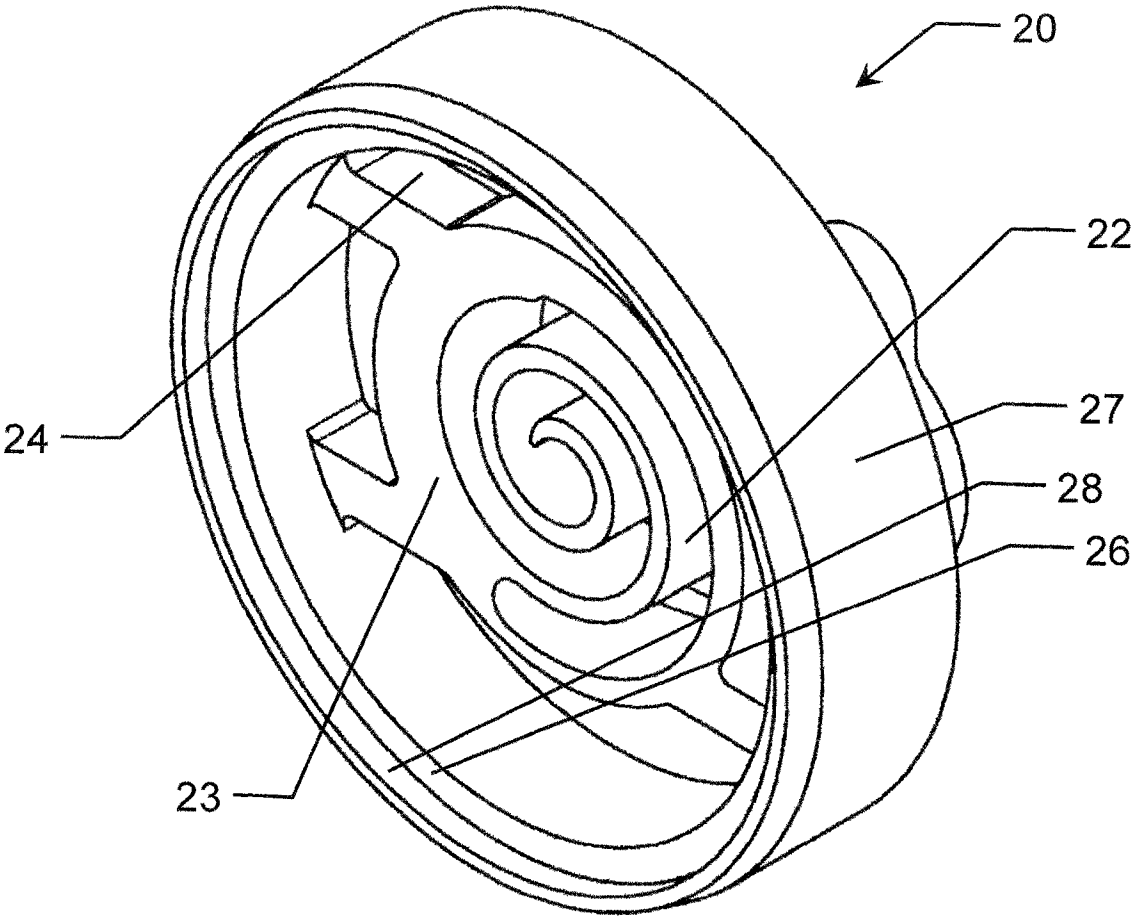
FIG. 5 is an isometric view of a fixed scroll according to the present invention.
Figure 6:
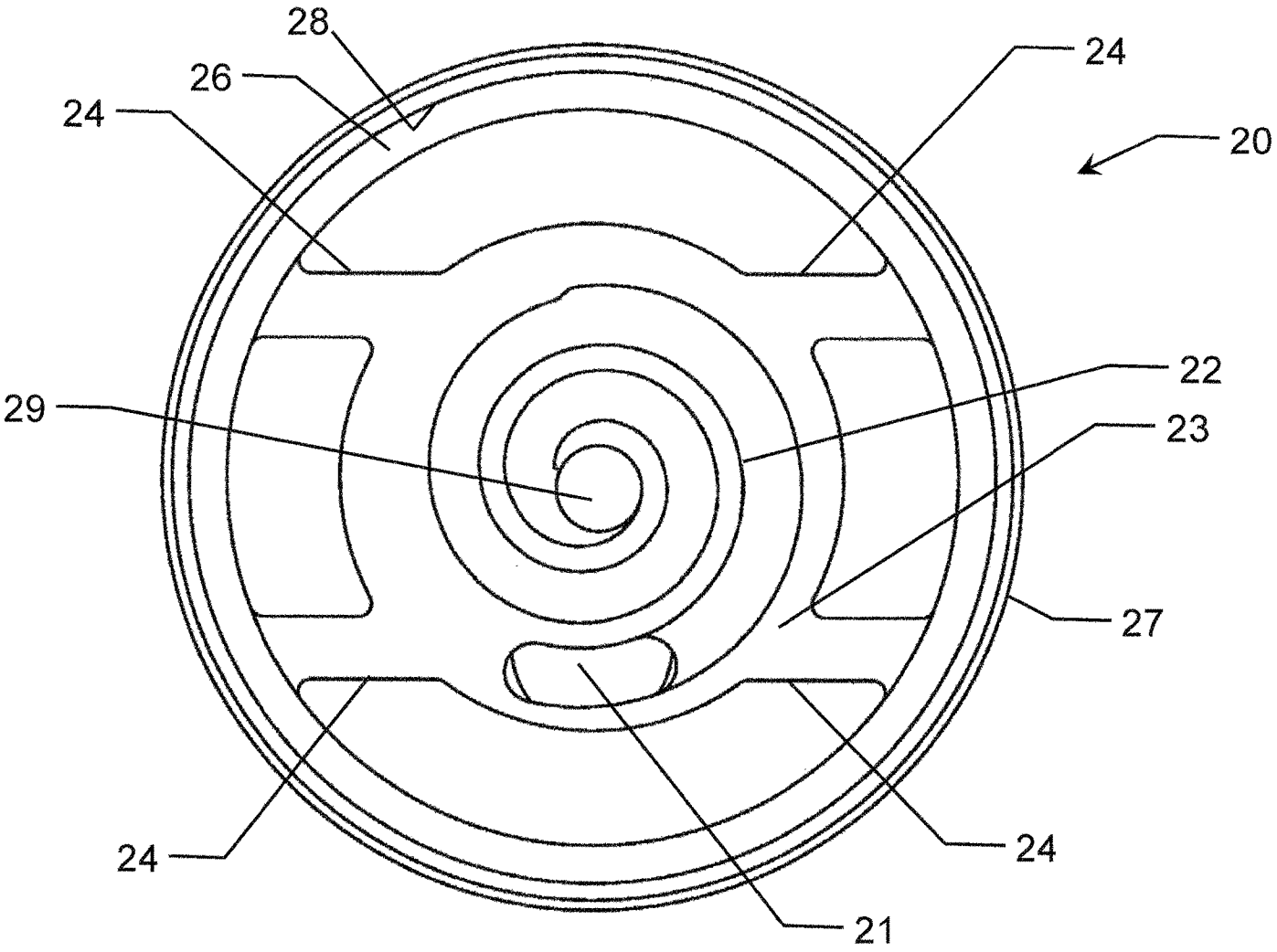
FIG. 6 is an orthographic plan view of the same fixed scroll.
Figure 7:
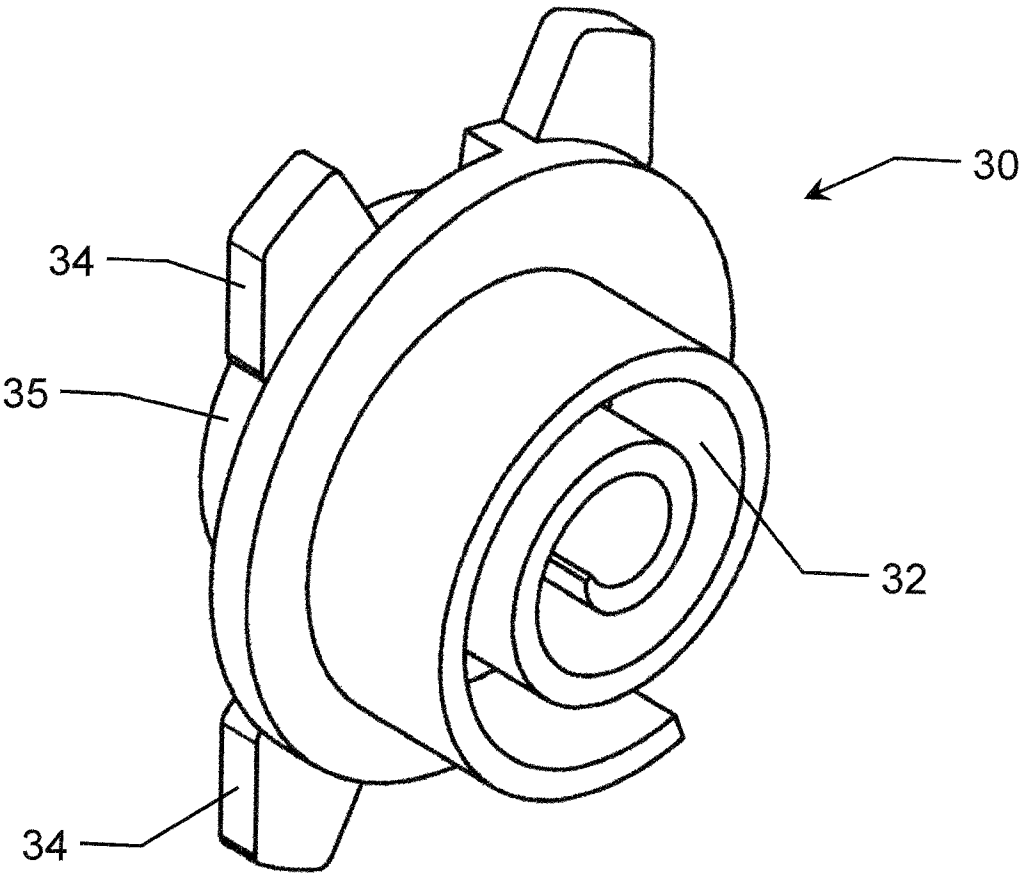
FIG. 7 is an isometric view of an orbiting scroll seen from the front or vane side according to the present invention.
Figure 8:
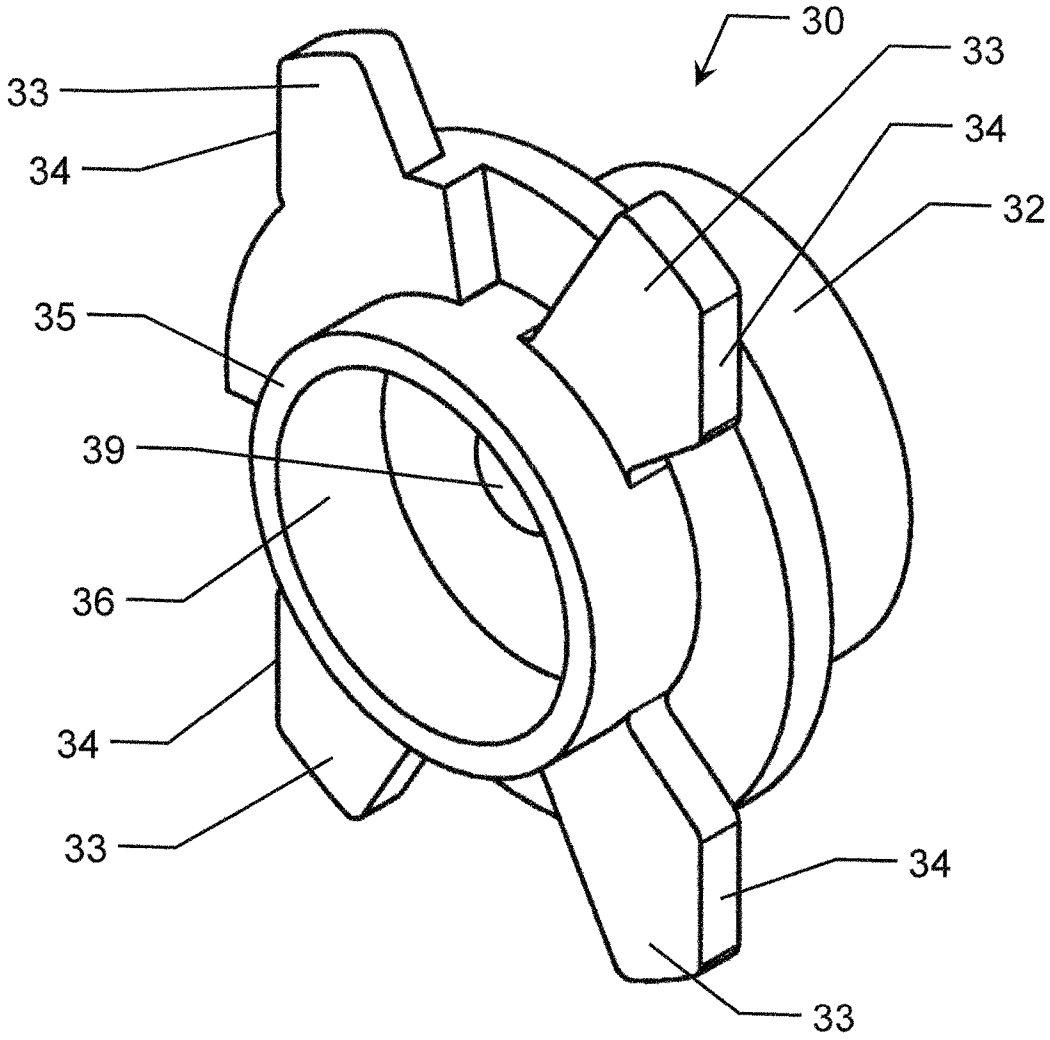
FIG. 8 is an isometric view of the orbiting scroll seen from the back or opposite of the vane side according to the present invention.
Figure 9:
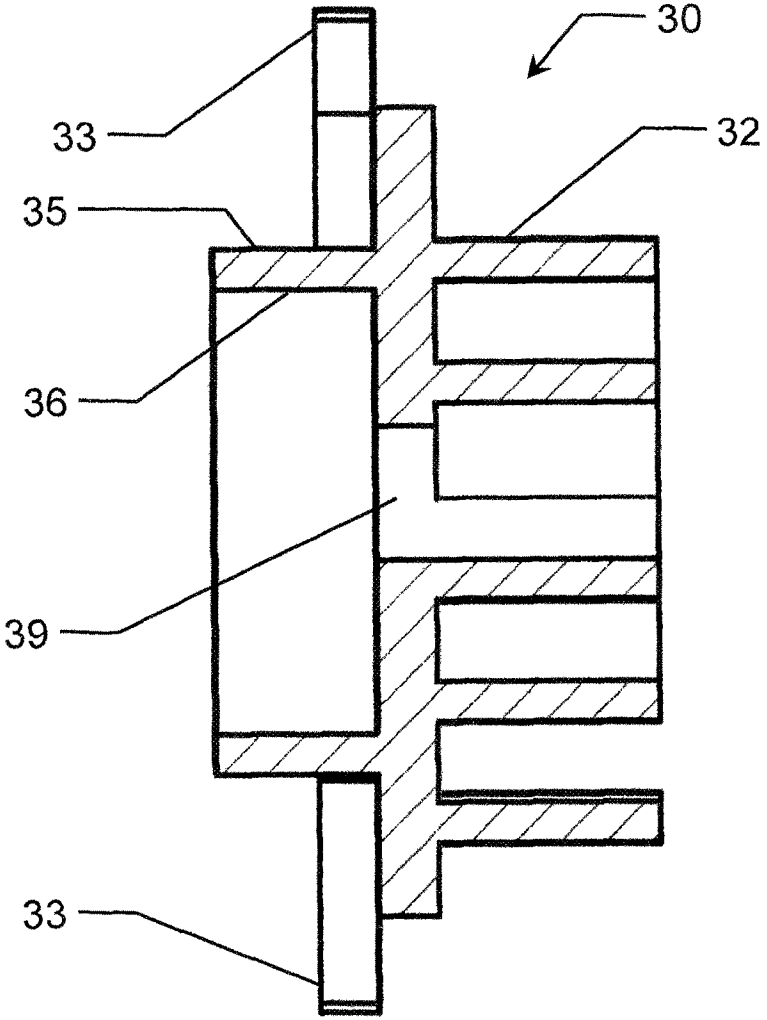
FIG. 9 is a cross-sectional orthographic side view of the same orbiting scroll.

The scroll machine of an embodiment of this invention is illustrated in the accompanying Drawing Figures, which illustrate the component parts thereof. Generally, the scroll compressor 10 of this embodiment includes a motor-compressor module 11 with a drive gallery 12. A motor chamber 14 is defined between the module 11 and a main compressor housing 80. The scroll pair is here shown as a fixed scroll 20 and a mating orbiting scroll 30, wherein the fixed scroll has an inlet (low-pressure) port 21 located on a radially outward portion, a fixed scroll spiral vane 22 having a tip surface 23. The fixed scroll 20 also has a flat face 24, shoulder 25, pilot floor 26, with an outside diameter 27 and pilot diameter 28. At the center of the scroll vane is a blind recess or mirror port 29, which will be explained later.

The orbiting scroll 30, which has a defined orbiting path 31 relative to the fixed scroll 20 has a scroll vane 32, a number of anti-thrust pads 33, a plurality of flat faces 34, a drive hub 35 on the side opposite the vane 32, with the drive hub having an inside diameter 36 defining a drive bearing contact point 37, a drive hub center 38 and a discharge port 39 that penetrates the scroll 30 more-or-less at the axis or center.

A drive widget 40 for achieving the orbital motion of the scroll 30 is comprised of a shaft bore 41, an eccentric crankpin 42 having a crankpin center 43, and a drive bearing 45 that has a predetermined drive bearing outside diameter 46. The shaft bore 41 has a shaft bore center 47 located at the main drive axis for the compressor. To prevent wobble or vibration caused by the eccentric motion of the orbiting scroll, the drive widget 40 also includes a primary counterweight 48 and a secondary counterweight 49.

Restraining the orbiting scroll 30 from any rotation relative to the fixed scroll is accomplished by an Oldham ring 50, here shown in the form of four arcuate segments, and whose shape defines key surfaces 54 that slidably engage the flat faces 24 and 34 of the fixed and orbiting scrolls 20 and 30, with the ring comprising a lateral dividing plane 56, a first segment pair 57 and a second segment pair 58.

A drive housing 60 that houses the aforementioned components is shown with a back-flange surface 61, a flat motor-engaging surface 62, and a pilot bore 63; a flat face 66 for engaging the fixed scroll pilot floor 26, and having an outside diameter 68. An outlet port 69 permits the compressed working fluid vapor to pass through.

Motive power for the orbiting scroll is provided here by an electric motor 70, having a motor shaft 71 with a shaft center or axis 77, a flat surface 72, and having pilot diameter 73. A set of motor bolts 74 or similar fasteners are provided to attach the motor to the drive housing.

The compressor housing 80 is shown with a flat surface or flange 81, an O-ring seal 83 and an annular O-ring groove 84, a retaining ring 85 and annular retaining ring groove 86, a bore 87, electrical feedthrough passage 88, and a discharge passage 89.

Referring first to FIGS. 1-4 of the Drawing, scroll compressor 10 includes fixed scroll 20 and orbiting scroll 30. Fixed scroll 20 and orbiting scroll 30 comprise a conventional scroll pair, each having involute shaped vanes 22 and 32 respectively which interfit to form pairs of moveable sealed crescent-shaped pockets. The scroll-type principle is well-known in the art and may be employed to transport, compress, or expand various fluids and gases.

Further referring to FIGS. 5-9 the orbiting scroll 30 is driven through a circular path by means of drive widget 40 which includes eccentric crankpin 42 and drive bearing 45 which together urge orbiting scroll 30 into contact with fixed scroll 20. Orbiting scroll 30 and fixed scroll 20 contact each other through orbiting scroll vane 32 and fixed scroll vane 22. Drive widget 40 including drive bearing 45 further urges orbiting scroll 30 to move in a circular path which is defined by the geometry of orbiting scroll vane 32 and fixed scroll vane 22. The orbiting scroll 30 is constrained to move in a lateral plane without rotation by means of Oldham ring 50. Four of eight key surfaces 54 of Oldham ring 50 slidingly engage fixed scroll 20 through a set of four flat faces 24 and the other four key surfaces 54 of Oldham ring 50 slidingly engage orbiting scroll 30 through a set of four flat faces 34.

Within the art, the Oldham ring is typically keyed between the scrolls as in the present invention or between the orbiting scroll and a fixed structure within the compressor such as a crankcase or bearing housing (e.g. drive housing 60). Keying to a fixed structure requires the additional step of angularly aligning the fixed scroll to the structure to provide the proper angular orientation between the orbiting scroll and the fixed scroll. Keying to a fixed structure offers the option to allow the Oldham ring to fit behind the orbiting scroll, i.e. between the orbiting scroll and the structure, which can offer advantages in (smaller) diametric size of the ring which may further facilitate a smaller diameter of the overall compressor. However, keying to a fixed structure requires the addition of precision machined surfaces to the structure (e.g. to drive housing 60) to engage the Oldham ring and precision alignment features to both the structure and to the fixed scroll to facilitate the scroll alignment operation, whether they are self-aligning or fixture-aligned. Keying between the two scrolls provides direct, built-in angular alignment with no need for additional alignment features or operations. The scrolls become self-aligning Keying between the scrolls also tends to concentrate the number ofprecision features into the two scroll parts and allows simpler and less precise (and thus less expensive) manufacture of non-scroll components.

In conventional prior-art scroll machines with the Oldham ring keyed between the scrolls, the body of the ring is typically a solid ring of a generally constant thickness evenly distributed about a lateral plane. Posts which extend axially from the body of the ring engage key-slots or flat faces on the two scroll components. The body of the ring maybe located between the two scrolls with posts extending from both sides of the body of the Oldham ring, or the body maybe located beneath the orbiting scroll with posts extending from one side of the body of the Oldham ring and with some features keying directly into the adjacent orbiting scroll and some features extending beyond the orbiting scroll to key into the fixed scroll. In both cases, a specific axial space must be set aside for the body of the ring, all at a single level.

Figure 10:
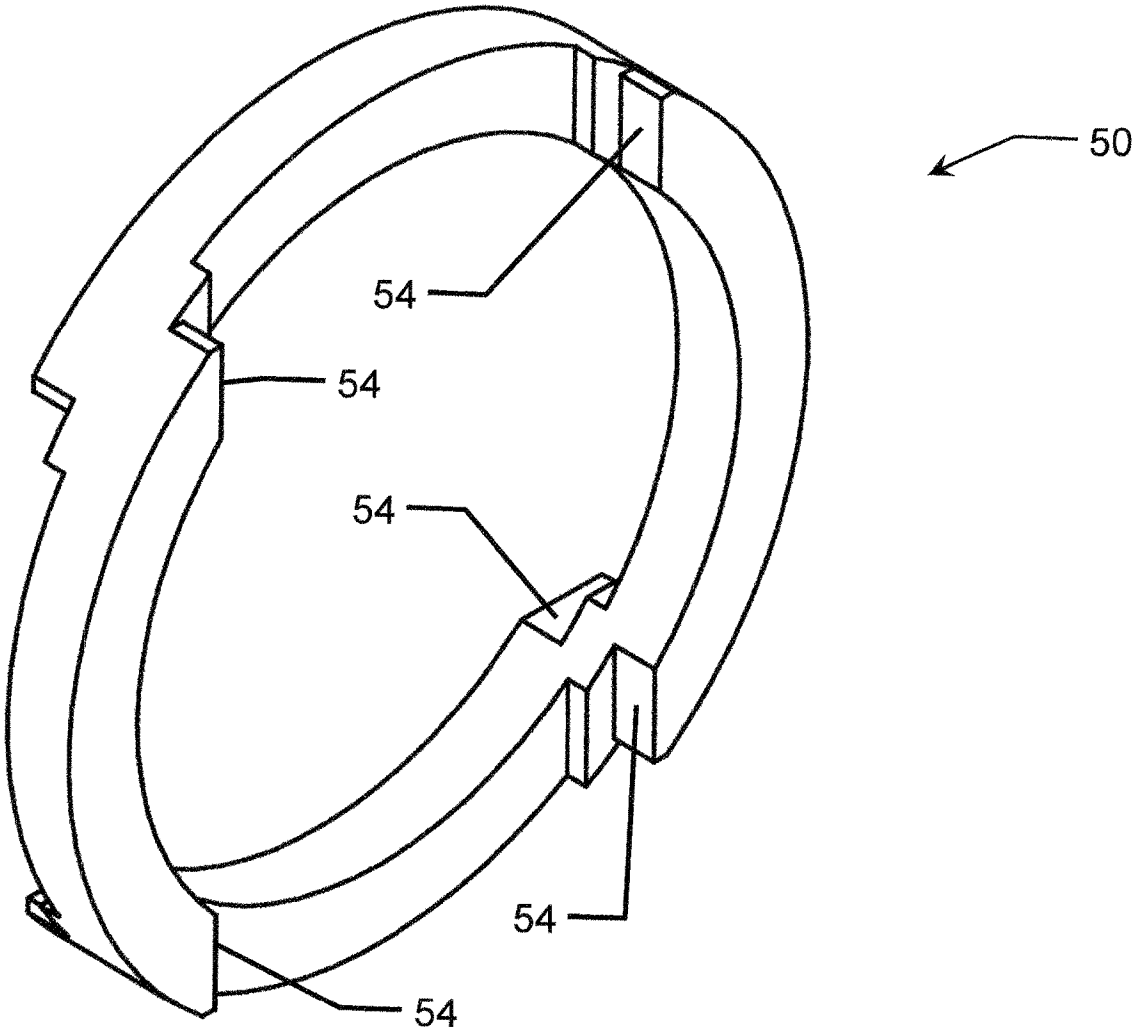
FIG. 10 is an isometric view of an Oldham ring as used in the present invention.
Figure 11:
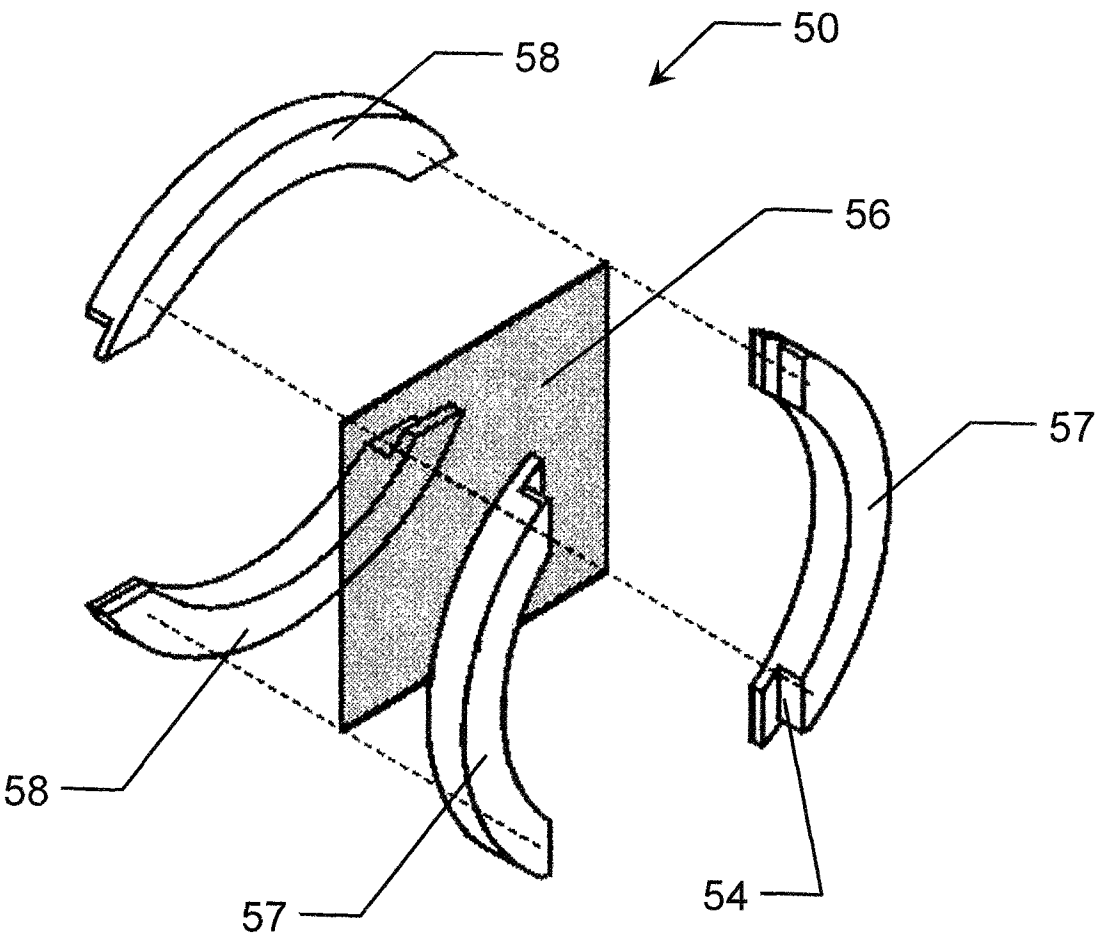
FIG. 11 is an isometric view of an Oldham ring divided into sections showing a dividing plane.

Referring to FIGS. 10 and 11, in the present invention, while Oldham ring 50 is a single, solid component, it is conceptually made up of four segments placed at two different axial locations. Segment pair 57 extends between the four flat surfaces 34 or 24 of orbiting scroll 30 or fixed scroll 20, respectively, and segment pair 58 extends between the four flat surfaces 24 or 34 of the other scroll, i.e. fixed scroll 20 or orbiting scroll 30, respectively. Segment pairs 57 and 58 are joined together at their ends at a single plane of symmetry 56. As a general rule, portions of segment pair 57 do not cross over the plane into the side occupied by segment pair 58 and likewise portions of segment pair 58 do not cross over the plane into the side occupied by segment pair 57. As a result, Oldham ring 50 does not require a dedicated axial space to be set aside for it. Instead each segment pair extends only between their respective set of flat surfaces 24 or 34 and occupies axial space which would otherwise be unused within the compressor. If desired, segment pairs 57 and 58 may be even further removed from plane 56 with axially extending segments joining the segment pairs 57 and 58 at the four pairs of segment ends.

Oldham ring 50 has been designed to be fully symmetric in that segment pair 57 is identical to segment pair 58 and Oldham ring 50 may be installed in any of four possible orientations in the compressor, i.e. it is not possible to mis-assemble it. It may be desirable in some cases to allow the ring to be non-symmetric across plane 56, such as having different spacing between the flat surfaces 24 on fixed scroll 20 and 34 on orbiting scroll 30. Segment pair 57 or segment pair 58 may also be non-symmetric, in that segment pair 57 may comprise two different shaped segments or segment pair 58 may comprise two different shaped segments. But whether the ring is designed symmetrically or non-symmetrically there will still be two segments operating on one side of a lateral plane 56 and two segments operating on the other side of plane 56.

Figure 12:
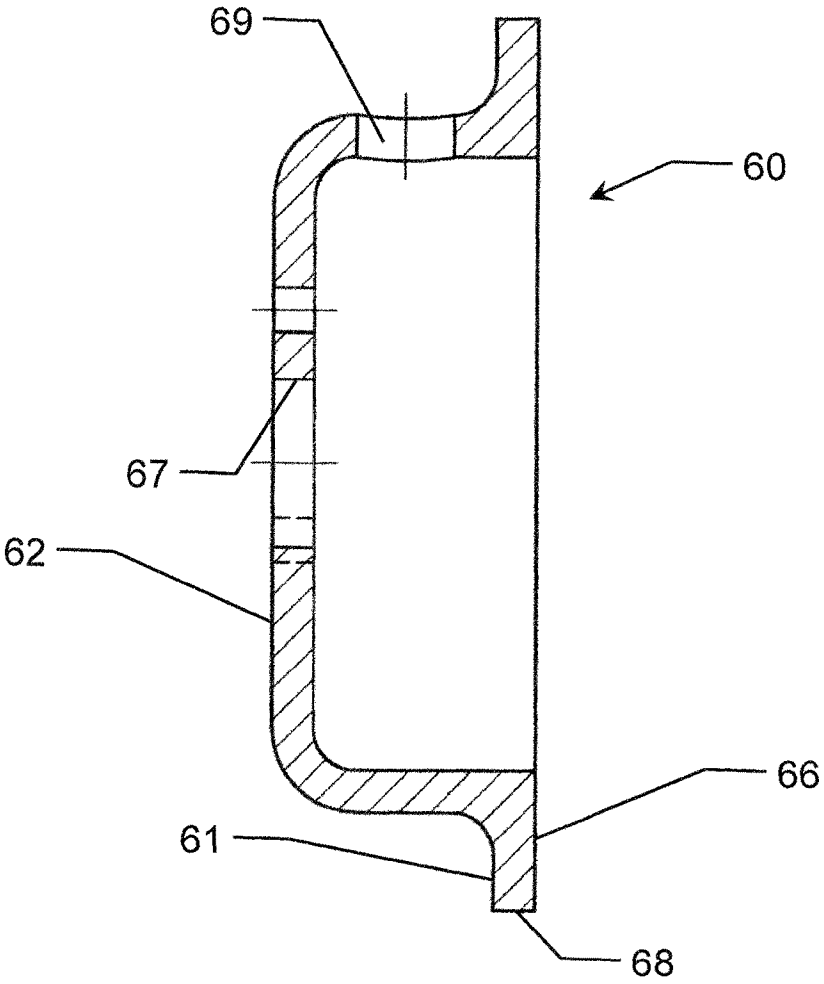
FIG. 12 is a cross-sectional orthographic side view of the drive housing.

Referring to FIG. 12 in addition to FIGS. 1-4, drive housing 60 nests within fixed scroll 20. Flat face 66 engages fixed scroll pilot floor 26 to establish axial position and perpendicularity between drive housing 60 and fixed scroll 20. Outside diameter 68 engages fixed scroll pilot diameter 28 to establish centerline concentricity between drive housing 60 and fixed scroll 20. In this example, the components are self-aligning through this engagement between features 66 and 26 and between features 68 and 28. Alternately, some or all of this alignment between the fixed scroll 20 and drive housing 60 may be provided through external fixturing for some or all alignment attributes with means provided to maintain alignment after the fixturing is removed.

Figure 13:
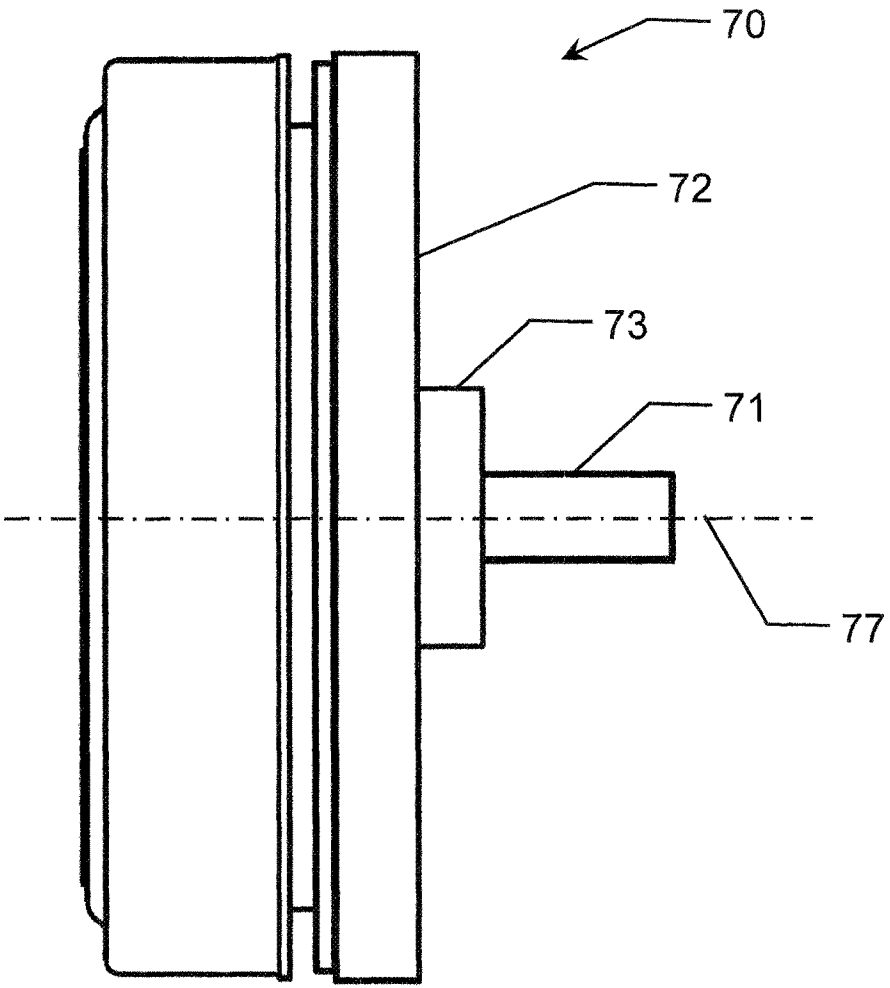
FIG. 13 is an orthographic representation of a motor as used in the present invention.

Additionally referring to FIG. 13, motor 70 is attached to drive housing 60 and motor shaft 71 extends into the scroll side of the drive housing. In this example motor 70 is secured to drive housing 60 by three bolts 74 although other attachment means may be used. Motor 70 is aligned axially and perpendicularly to drive housing 60 through flat surface 72 which engages flat surface 62 of drive housing 60. Motor 70 is aligned concentrically with drive housing 60 through pilot diameter 73 which engages pilot bore 63 of drive housing 60. Alternately, some or all alignment between motor 70 and drive housing 60 may be provided through external fixturing with means provided to maintain alignment after the fixturing is removed. In the present invention, motor 60 is an electric motor but it is understood that motor 60 could be a hydraulic motor, pneumatic motor, or any other prime mover which provides a rotary output.

Figure 14:
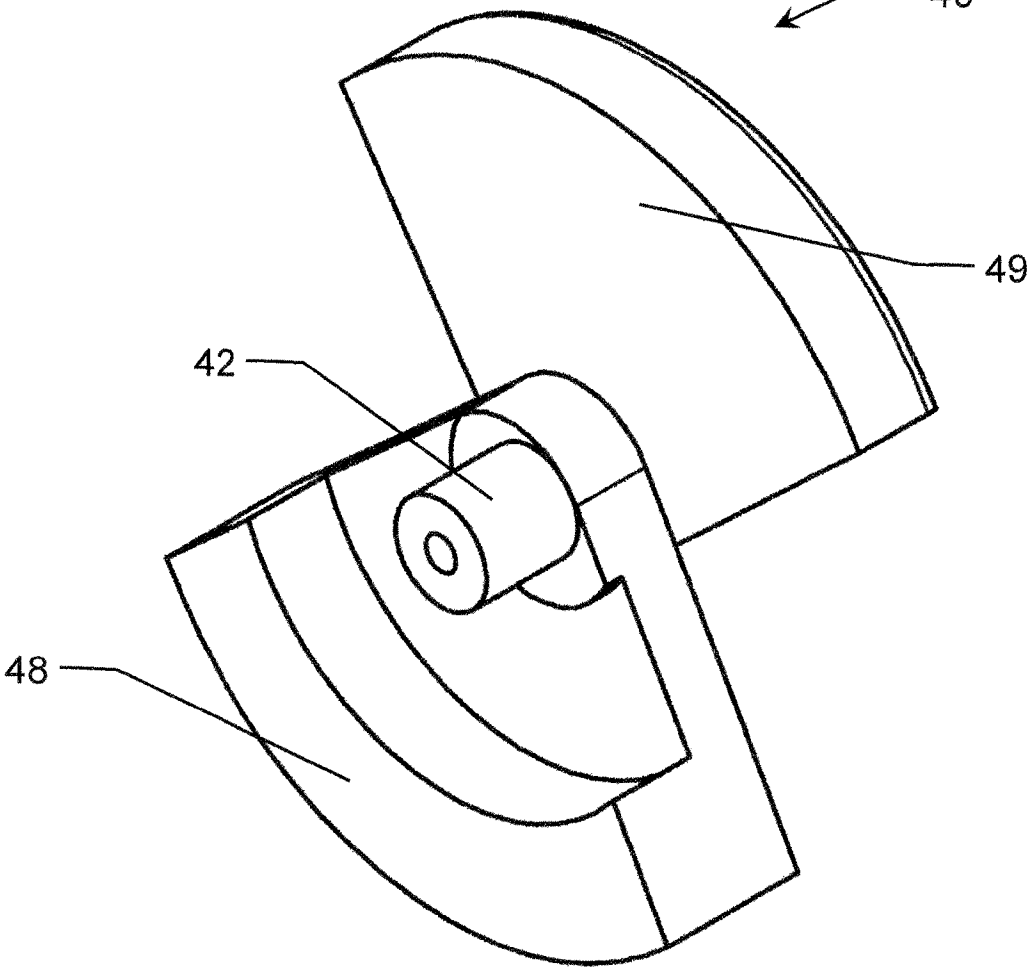
FIG. 14 is an isometric view of the drive widget as used in the present invention.
Figure 15:
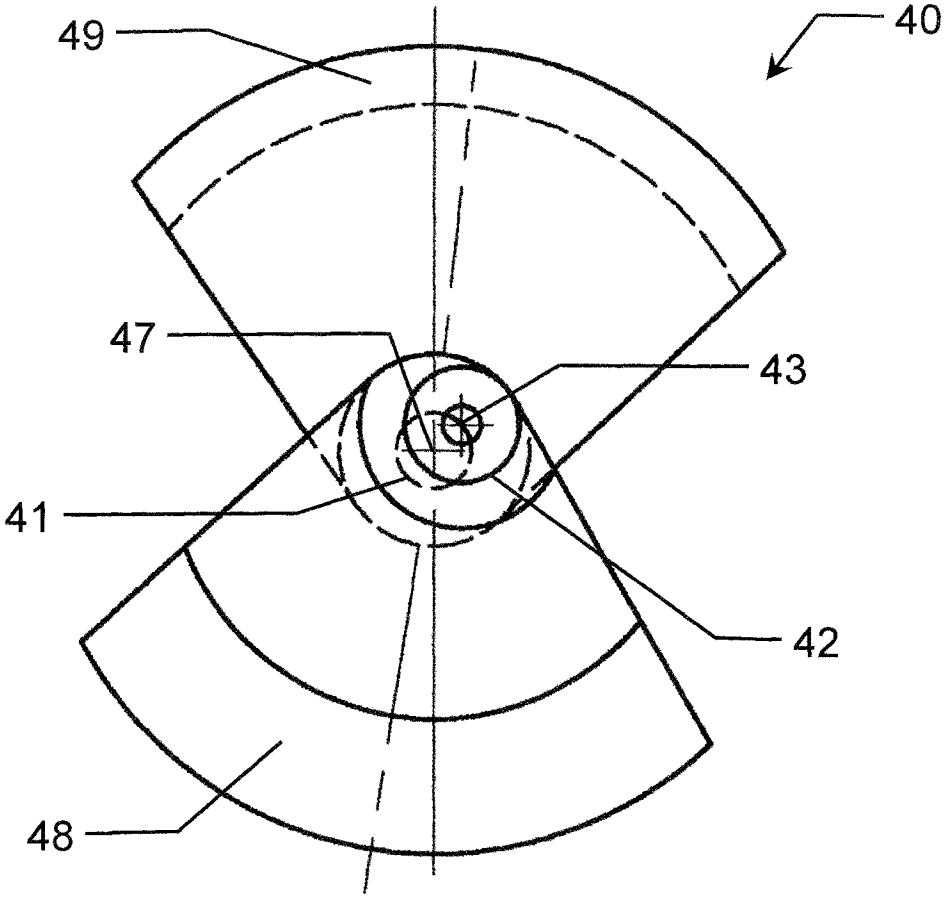
FIG. 15 is an orthographic plan view of the drive widget.
Figure 16:
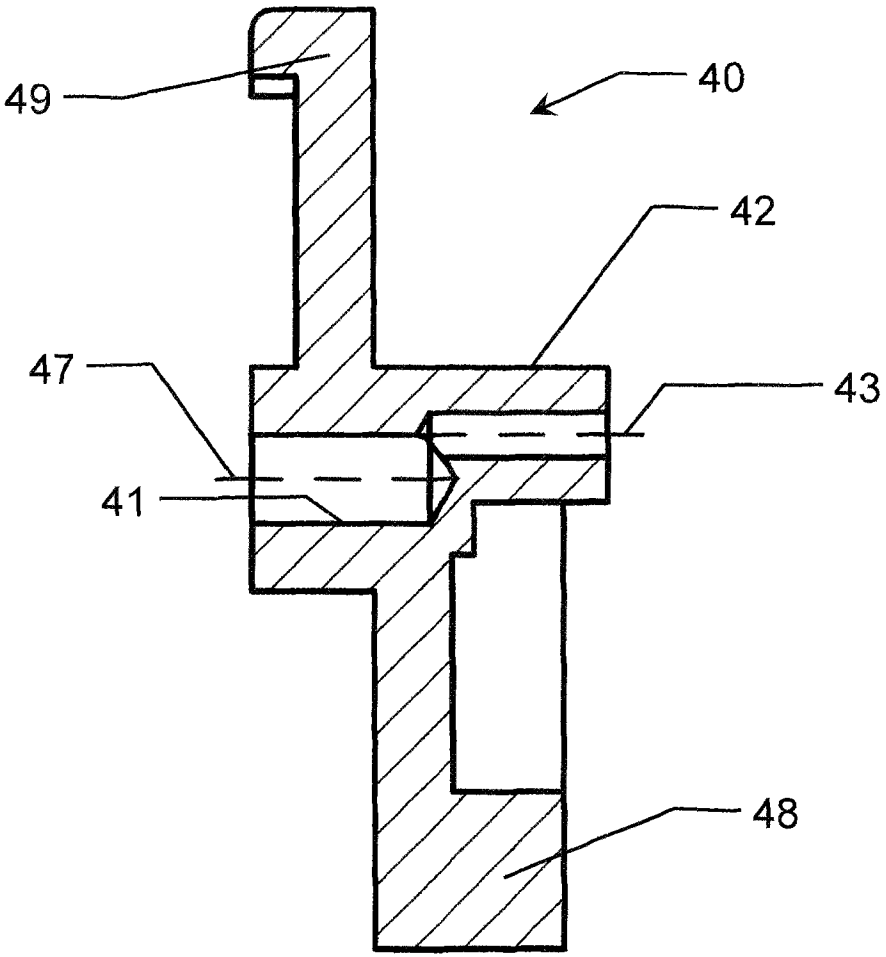
FIG. 16 is a cross-sectional orthographic side view of the drive widget.

Now, referring to FIGS. 14-16, drive widget 40 is attached to motor shaft 71. In this example the drive widget 40 is pressed onto the shaft 71 through an interference fit between shaft bore 41 and shaft 71 but it is understood that any of a wide variety of attachment methods may be used, including combining drive widget 40 and shaft 71 into a single component. Drive widget 40 is aligned to the shaft 71 concentrically and perpendicularly through the press fit on the shaft 71. The axial position of drive widget 40 with respect to motor 70 may be determined by physical features in or adjacent the shaft bore 41 and motor shaft 71 or by external fixturing during manufacture or assembly.

Drive bearing 45 is fitted over eccentric crankpin 42. In this example drive bearing 45 is a ball bearing pressed on to the crankpin 42; however a number of other bearing types may be used including a solid disk with a smooth bore running directly against the eccentric crankpin 42. Drive bearing 45 is aligned to the drive widget 40 through the fit between drive bearing 45 and crankpin 42 and through axial locating features such as a mechanical stop or through external fixturing.

The axial, perpendicular, and concentric alignment chain between the fixed scroll 20, drive housing 60, motor 70, and drive widget 40 including drive bearing 45 all combine to determine the position of the drive bearing 45 relative to the fixed scroll 20 in the compressor assembly. Orbiting scroll 30 is interposed between fixed scroll 20 and drive bearing 45. The orbiting scroll 30 is not rigidly constrained to be in any one particular position or orientation relative to any other compressor components. Orbiting scroll 30 may freely move laterally or radially within the limits of the geometry of fixed and orbiting scroll vanes 22 and 32 and also within the limits of the radial clearance space between drive bearing 45 and drive hub inside diameter 36. Orbiting scroll 30 is free to move axially inside the clearance allowed within the space defined between the fixed scroll tip surface 23 and the flat face 66 of drive housing 60. In this way, when the compressor is not in operation, orbiting scroll 30 may be said to be "rattling loose" in the assembly with no particular position or orientation imposed upon it.

In the assembly, drive bearing 45 is positioned within the orbiting scroll drive hub inside diameter 36 and, when driven by motor 70 through the drive widget 40, drive bearing outside diameter 46 acts against the drive hub inside diameter 36 at contact point 37 to urge the orbiting scroll vane 32 against the fixed scroll vane 22 in the lateral or radial plane and to follow a circular orbit path as defined by the resulting contact between fixed scroll vane 22 and orbiting scroll vane 32.

Figure 17:
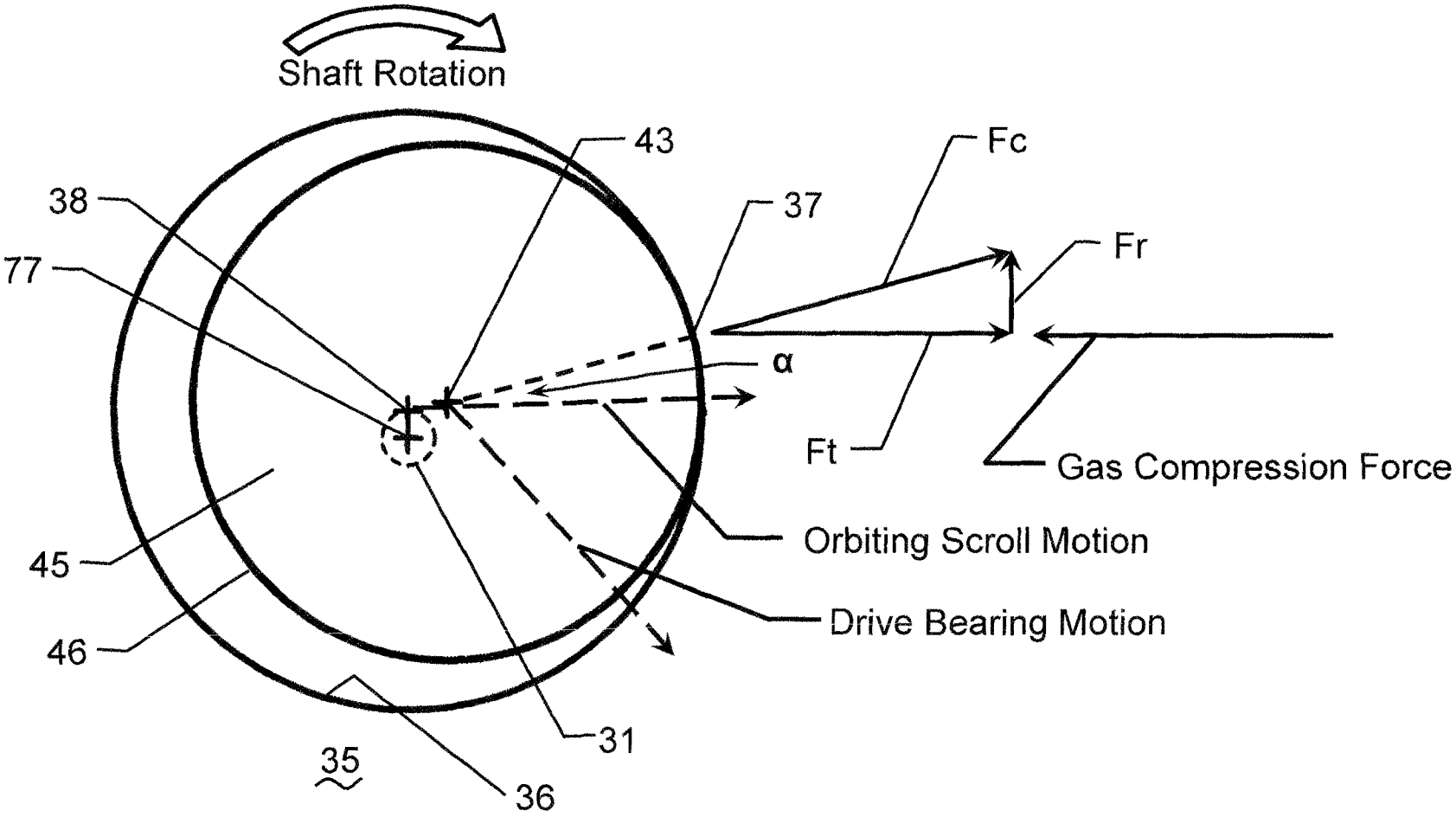
FIG. 17 is a schematic representation of the drive system including the drive bearing and orbiting scroll drive hub.

FIG. 17 shows a schematic representation of the drive bearing 45 with an outside diameter 46 and a drive bearing center 43 situated inside the drive hub 35 which has an inside diameter 36 and a center 38. Motor shaft center 77 is coincident with the center of fixed scroll 20 and defines the center of rotation for drive widget 40. During normal operation, when orbiting scroll vane 32 is in contact with fixed scroll vane 22 and drive bearing outside diameter 46 is pushing against drive hub inside diameter 36, the orbiting scroll is constrained through pressure and inertial loads to move in a circular orbit path 31 which is centered on fixed scroll 20 and which is defined by the respective geometries of fixed scroll vane 22 and orbiting scroll vane 32. In FIG. 17, the motor shaft 71 and thus also the drive widget 40 are rotating in a clockwise direction and drive bearing center 43 is also moving in a clockwise direction in a circular path centered on shaft center 77.

Drive bearing outside diameter 46 contacts the drive hub inside diameter 36 at contact point 37 and the instantaneous direction of motion of the orbiting scroll 30 is to the right as indicated in FIG. 17 even though drive bearing center 43 is moving down and to the right as also indicated in FIG. 17. Assuming there is no slippage between drive bearing outside diameter 46 and drive hub inside diameter 36 at contact point 37 the difference in velocity vectors between the orbiting scroll center 38 and drive bearing center 43 results in a rolling action between drive bearing 40 and drive hub inside diameter 36. As a result of the rolling action, drive bearing outside diameter 46 will rotate in a counterclockwise direction as viewed in FIG. 17 even though the drive system is rotating in a clockwise direction. The total rotational speed of drive bearing 45 relative to crankpin 42 will be the sum of the rotation induced by this reverse rolling action plus the rotational speed of the motor shaft 71. Thus it is necessary to design drive bearing 45 to run at a somewhat higher rotational speed than that of the motor shaft 71.

The contact force Fc between drive bearing outside diameter 46 and drive hub inside diameter 36 is applied at contact point 37 and is directed normal to the two surfaces 46 and 36 at the point of contact. This contact force Fc will have a component Ft which acts in the instantaneous direction of motion of the orbiting scroll 30. This force balances a gas compression force generated within the scroll pair which resists the action of drive bearing 45 and represents the force against which the work of compression is accomplished.

In this example, the drive bearing center 43 is positioned so that the line of action of the contact force Fc acts at an angle $\alpha$ to the instantaneous direction of orbiting scroll motion. In this manner, in addition to contact force Fc generating a tangential force component Ft in the direction of orbiting scroll motion to accomplish the work of compression, contact force Fc also generates a radial force component Fr which acts to push the orbiting scroll 30 radially outward to increase the loading between the orbiting scroll vane 32 and the fixed scroll vane 22. This may be done to counteract a radially inward-acting gas force generated by the scroll set which tends to separate the orbiting and fixed scroll vanes 32 and 22. In larger compressors, where the centrifugal inertial action of a larger, heavier orbiting scroll is sufficient to counteract the radial gas force, the drive bearing center 43 may be repositioned to reduce or eliminate the outward-acting radial force component Fr of the contact force Fc or even to reverse the radial force component Fr to act radially inward against the centrifugal inertial action of the orbiting scroll 30 and thus to reduce the load between orbiting and fixed scroll vanes 32 and 22.

The advantage of this drive system, as opposed to simply rigidly mounting drive bearing 45 in drive hub 35, where the orbiting scroll 30 is driven in a fixed circular path centered on motor shaft 71 as opposed to the path defined by scroll vanes 22 and 32, is in its tolerance for deviations in the actual orbit path 31 from the ideal circle centered on motor shaft 71. Normal manufacturing dimensional and alignment tolerances result in a vane-generated orbit path which deviates significantly from the ideal, shaft-centered orbit path. In the drive arrangement of FIG. 17 the orbiting scroll 30 is able to move radially inward and outward in response to deviations in the vane-generated orbit path. The orbiting scroll vane 32 and fixed scroll vane 22 are thus able to remain in continuous sealing contact. As orbiting scroll 30 moves radially inward and outward, orbiting scroll center 38 in the Figure moves down or up, respectively, and contact point 37 moves in a direction to increase or decrease contact angle $\alpha$, also respectively.

If orbiting scroll 30 were constrained to rigidly follow a circular path centered on shaft center 77, it would be necessary to reduce the radius of orbit path 31 in order to avoid mechanical interference between scroll vanes 32 and 22 resulting from manufacturing and assembly alignment tolerances. The radially compliant drive system defined by drive widget 40 and drive hub 35 as illustrated in FIG. 17 allows the scroll vanes to remain in sealing contact in spite of necessary deviations imposed by manufacturing variations. It also allows transient deviations from the ideal orbit path in the presence of contaminants or liquid in the scroll set which would otherwise result in interference or hydraulic lock.

In addition to providing the function of the eccentric crankpin 42 and drive bearing 45, drive widget 40 also provides two counterweights, primary counterweight 48 and secondary counterweight 49. The size, location, and orientation of the two counterweights 48 and 49 are selected and calibrated so that the entire rotodynamic system defined by drive widget 40 including drive bearing 45, orbiting scroll 30, and Oldham ring 50 is in both static and dynamic balance. In conventional scroll machine designs the three functions of the drive system, i.e. the mechanical drive, primary counterweight, and secondary counterweight, are normally carried out by separate components distributed at separate locations along a drive-shaft which also includes an integrated motor.

The present invention decouples the mechanical drive function from the motor 70 and allows either the drive system (drive widget 40 and orbiting scroll drive hub 35) or the motor 70 to be modified with little if any impact on the other. Additionally, the specific geometric relationships between the eccentric crankpin 42 and the two counterweights 48 and 49 are "locked in" to a single component instead of requiring assembly and alignment of various components in various operations. Any prime mover, whether electrical, hydraulic, pneumatic, or otherwise need only meet requirements of shaft output, radial shaft loading, and mechanical interface in order to be applied to this compressor. No significant redesign or retooling is needed to change from one motor type or design to another.

Figure 18:
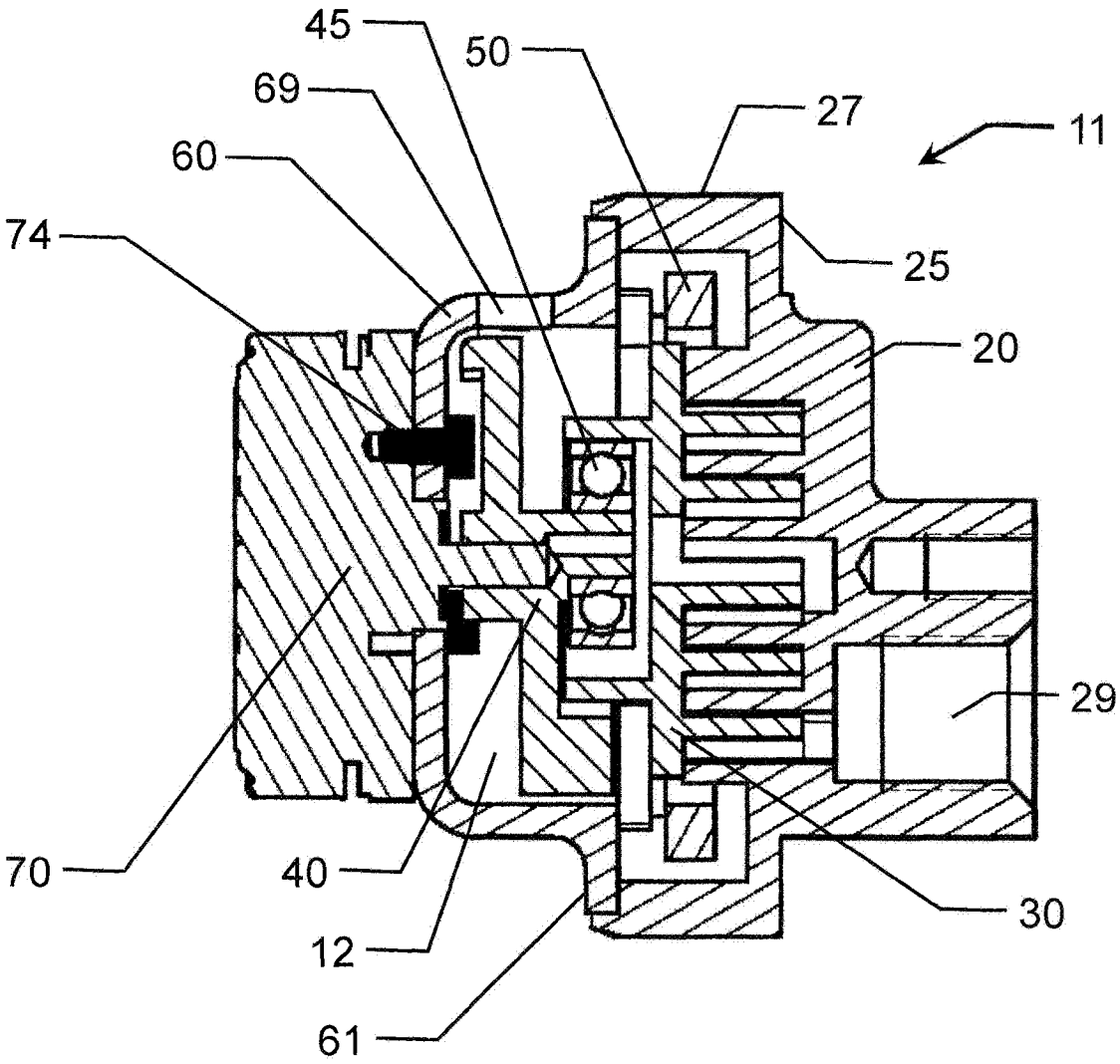
FIG. 18 is a cross-sectional orthographic side view of the motor-compressor module.
Figure 19:
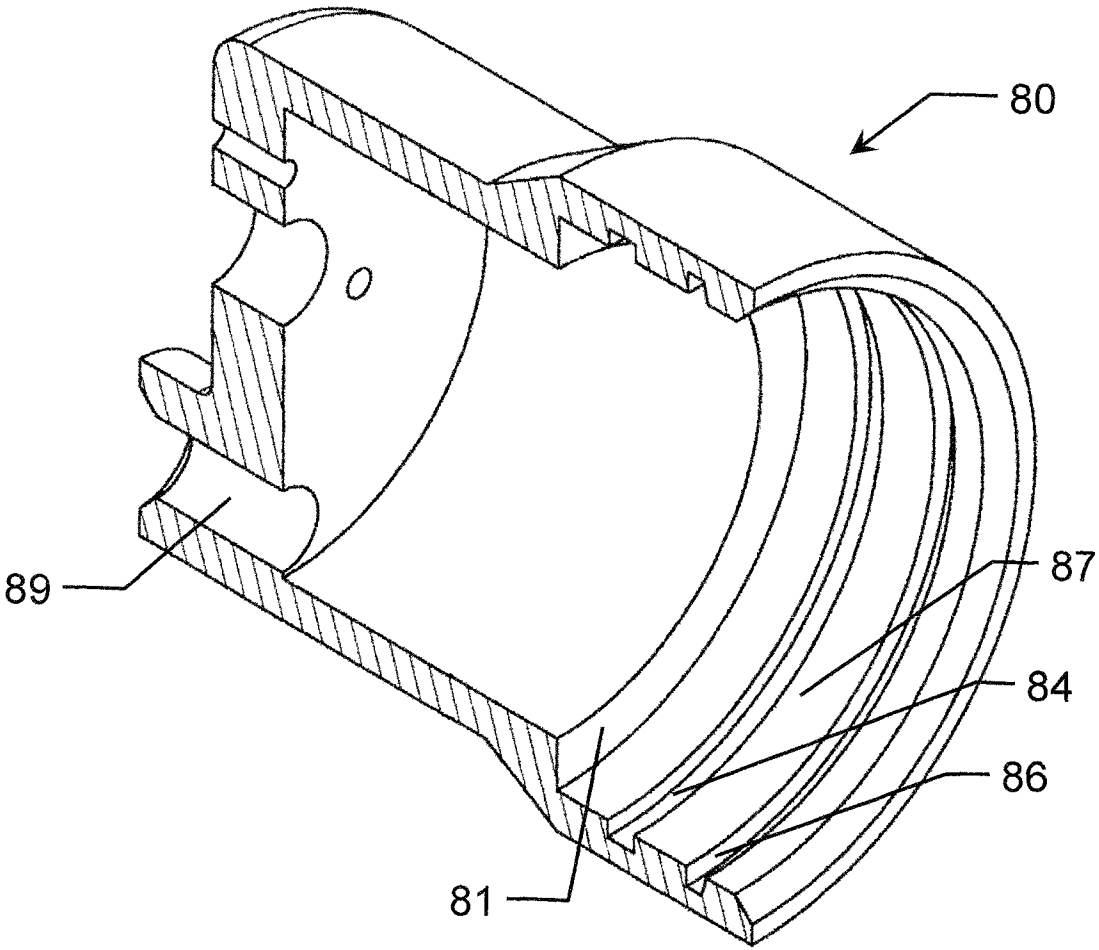
FIG. 19 is a cross-sectional isometric view of the compressor housing.

The combined assembly of fixed scroll 20, orbiting scroll 30, the drive widget 40 (including drive bearing 45), Oldham ring 50, drive housing 60, and motor 70 together form an integrated motor-compressor module 11 which may be packaged and applied in a number of different ways. Motor-compressor module 11 is illustrated in FIG. 18. In the present invention, motor-compressor module 11 is mounted within a semi-hermetic compressor housing 80. In addition to appearing in FIGS. 1-4, compressor housing 80 is illustrated in detail in FIG. 19. The back-flange surface 61 of drive housing 60 seats against flat surface 81 of compressor housing 80 which establishes the axial position of motor-compressor module 11 within compressor housing 80. The fixed scroll outside diameter 27 matches the compressor housing bore 87 closely enough for a snug fit, which establishes the radial position (concentricity) of the fixed scroll 20 and thus the concentricity of the motor-compressor module 11 within compressor housing 80. A sealing element 83 fits within seal groove 84 in the side wall of bore 87 and seals against fixed scroll outside diameter 27. Beveled retaining ring 85 fits within retaining ring groove 86 of compressor housing 80 and seats against fixed scroll shoulder 25. The bevel-spring action of the retaining ring 85 loads and clamps drive module 11 within compressor housing 80. In this manner the motor-compressor module 11 is located and sealingly secured within compressor housing 80. Electrical feed-through 88 is/are provided to conduct motor power leads into the sealed space within compressor housing 80, and a discharge passage 89 is provided for compressed vapor to exit the compressor housing.

This design concept may be easily converted to a hermetic-type compressor by eliminating the retaining ring 85 and joining the compressor housing 80 to the fixed scroll outside diameter 27 with some sort of vapor-tight seal such as welding, swaging, brazing, soldering, roll forming, crimping, bonding, or other suitable joining process. A ring type seal 83 or an applied sealant may optionally be used in addition to the joining process to assure gas-tightness of the joint. Suitable hermetic power terminals and piping connections would replace the corresponding threaded and gasketed components in this design example.

When motor 70 is energized, causing motor shaft 71 and drive widget 40 to rotate, orbiting scroll 30, as described above, is driven in a circular path with orbiting scroll vane 32 bearing radially against fixed scroll vane 22. The orbiting scroll 30 is prevented from any rotational motion by the action of Oldham ring 50 between orbiting scroll 30 and fixed scroll 20. The scroll vanes interact in the conventional manner, vapor is transported from the inlet port 21, compressed within sealed crescent-shaped chambers, and discharged into the drive housing 60 through discharge port 39. Fixed scroll 20 also has a "mirror port" blind recess 29 which aids in the discharge flow process.

The high-pressure discharge port 39 through the orbiting scroll floor directs the full discharge flow into the drive bearing system, which is unusual if not unique in current scroll practice. The normal arrangement has the discharge flowing through the fixed scroll 20 (with an open, through port in place of blind mirror port recess 29) with the space behind orbiting scroll 30 reserved for bearing, drive, and lubrication systems which are intentionally kept separate from the direct flow through the compressor.

In a conventional closed-loop refrigeration or air conditioning circuit some percentage of the compressor lubricant is circulating throughout the system at any given time. This is due in large part to the inherent difficulty of fully separating the lubricant from the refrigerant flow. Conventional compressor designs capture as much of the returning lubricant as practical and return it to an internal sump to replenish lubricant which is lost to the discharge flow from the compression mechanism. When applied in a closed-loop system the present invention directs all returning lubricant directly into the compression chambers and discharges the full combined refrigerant and lubricant flow into drive gallery 12 which is the space defined by the combination of the fixed scroll 20, drive housing 60, and motor 70. Drive gallery 12 contains or is adjacent to all critical moving parts in the compressor, including drive widget 40 with drive bearing 45, Oldham ring 50, the sliding tip-to-floor interface between the fixed scroll 20 and orbiting scroll 30, and the motor shaft bearings.

So-called high-side compressor designs, both scroll and non-scroll, where all returning flow passes through the compression mechanism and discharges into the mechanical drive space which operates in the discharge pressure environment, are well-known in the art. However, conventional designs direct the flow through a discharge port in the fixed scroll and along a path separated from direct exposure to the mechanical drive and lubricant sump. These provide means to separate the lubricant flow from the compressed vapor flow, and return the lubricant to an isolated, managed sump from which a lubricant pumping system delivers lubricant to the bearings and scroll drive. Conventional (i.e. commercially produced) low-side compressor layouts are very similar in that the lubricant flow is separated and returned to the sump where pumping and distribution means deliver the lubricant to the bearing and drive system. The most significant difference is the suction pressure environment in the mechanical drive space and that the lubricant separation process takes place upstream, i.e. before the compression device instead of after.

Mist-lubricated compressors, including scroll-types as well as others, are also well in the art. They are most commonly applied in automotive air conditioning applications or other small transport air conditioning and refrigeration applications. However, as a rule they are low side designs with the discharge flow exiting the compressor from a fitting connected directly to a discharge port in the fixed scroll.

Any and all lubricant and vapor passing through compressor 10 will be discharged through port 39, through and around drive bearing 45, and into drive gallery 12. The compressed vapor exits drive gallery 12 through outlet port 69 along with whatever lubricant remains entrained in the vapor flow. In this embodiment port 69 is at the top of drive gallery 12 in an effort to allow gravity to collect lubricant on the opposite side at the bottom of drive gallery 12. Other means, such as baffles or deflectors within drive gallery 12 or around port 69 may be added to further separate the lubricant flow and to tend to retain lubricant within drive gallery 12. In this way drive gallery 12 tends to act as a lubricant sump, but one which is not managed. There are no means for lubricant pumping or distribution. Any lubricant delivery from the bottom of drive gallery 12 will be through splashing action of the moving parts and the turbulent vortex flow driven by the rotating drive widget 40. As long as lubricant is returning from the system to compressor 10 through the suction flow there is no need for a lubricant reserve in drive gallery 12. However, if more lubricant remains resident in drive gallery 12, that will permit for a lower percentage of lubricant circulation in the system, which is generally desirable. This also provides a lubricant reserve for critical moving parts in the event of a transient loss of lubricant return.

The discharge pressure acting on the drive hub side of orbiting scroll 30 serves to load it against the fixed scroll 20 in opposition to the internally pressure-generated axial force which tends to separate the scrolls. In this way the scrolls are pressure-loaded together for effective contact sealing between tip and floor surfaces.

During the startup phase of the compressor the discharge and suction sides are at equal pressure and so there is no force to push the scrolls together. However on startup there is almost immediately an internally-generated pressure from the compression action within the scroll set which tends to push the orbiting scroll 30 away from fixed scroll 20. During this startup phase anti-thrust pads 33 adjacent flat faces 34 on orbiting scroll 30 bear against flat face 62 of drive housing 60. This necessarily results in axial clearance between orbiting scroll 30 and fixed scroll 20 which allows leakage between adjacent compression volumes. This leakage results in degraded performance and flow through compressor 10. However if the axial clearance is controlled within reasonable limits the compressor 10 will generate enough flow to create back pressure against the system restriction or load until enough pressure is developed to overcome the axial separating gas force and to axially load the orbiting scroll 30 against the fixed scroll 20. In this way the compressor "bootstraps" itselfup from a balanced-pressure start.

After exiting drive gallery 12 through port 69 the compressed vapor flows into motor chamber 14 where the vapor absorbs heat rejected by the motor, i.e. the motor is cooled by the vapor flow. After flowing around the motor, the vapor exits the compressor through discharge passage 89. In the present invention, discharge passage 89 is placed at the bottom of motor chamber 14 to avoid creating "traps" or pockets where lubricant could collect away from the main vapor flow. Any carryover lubricant in the discharge vapor flow will be carried along by the flow and the force of gravity to discharge passage 89 and flows back to the system to be returned again to the compressor the next time around.

The above-described embodiment(s) are given as examples of implementing the invention. The invention is not to be limited to the foregoing illustrative embodiments thereof. Rather many modifications and variations thereof are possible within the scope of this invention which is to be measured by the appended claims.

What is claimed is:

1. A scroll-type displacement machine adapted to move a working fluid between a low-pressure environment and a high-pressure environment, the scroll-type displacement machine comprising:

a housing;

a scroll pair comprising an orbiting scroll and a fixed scroll, said fixed and orbiting scrolls having respective spiral vanes which interfit with one another;

Oldham ring means coupled to said fixed and orbiting scrolls for constraining said orbiting scroll against rotation but permitting said orbiting scroll to enjoy orbital motion about an axis of said fixed scroll;

a rotary drive shaft having a rotary axis and adapted for rotary motion about said rotary axis;

bearing means supporting said rotary drive shaft within said housing and permitting said rotary drive shaft to enjoy rotary motion within said housing;

eccentric drive bearing means positioned on said drive shaft adjacent said scroll pair and operatively coupled to said orbiting scroll such that rotation of said drive shaft corresponds with orbiting motion of said orbiting scroll;

said housing enclosing at least said eccentric drive bearing means, at least a portion of said scroll pair, and at least a portion of said rotary shaft;

said fixed scroll having a low-pressure port located in a radially outer portion of the spiral vane thereof and communicating with said low-pressure environment;

said orbiting scroll having a high-pressure port disposed at a radially central portion of the spiral vane thereof;

internal routing coupled to the high-pressure port resulting in said high-pressure environment being located in the interior of said housing; and wherein said high pressure port is positioned relative to said eccentric drive bearing means such that high pressure working fluid passes directly from the high pressure port over said eccentric drive bearing means and from there through a flow path into said interior of said housing such that fluid flow first serves to pass over the drive bearing means and at least an adjacent surface of said orbiting scroll.

2. The scroll-type machine according to claim 1, wherein said working fluid includes entrained lubricant, and said internal routing is adapted such that lubricant entrained in the high-pressure environment within said housing provides lubrication for at least said eccentric drive bearing means.

3. The scroll-type machine according to claim 1 wherein said scroll-type machine is configured as a compressor and said internal fluid routing directs flow of said working fluid in a direction from said low-pressure environment into said high-pressure environment.

4. The scroll-type machine according to claim 3 further comprising a closed-loop path for said working fluid in which the working fluid exits a pressure port in said housing and is returned to said low-pressure port of said fixed scroll, and wherein said working fluid re-circulates through said scroll machine.

5. A scroll-type displacement machine comprising:

a scroll pair including an orbiting scroll and a fixed scroll;

a drive shaft;

bearing means supporting said drive shaft for rotational motion about an axis of said shaft with an output end of said drive shaft projecting beyond said bearing means;

eccentric drive bearing means affixed to said output end of said drive shaft adjacent said scroll pair and adapted to drive said orbiting scroll in a generally circular orbital path relative to said fixed scroll;

a primary counterweight affixed to said drive shaft;

a secondary counterweight affixed to said drive shaft and spaced axially from said primary counterweight, such that the primary counterweight and the secondary counterweight are configured so as to provide static and dynamic rotational balance for said scroll-type displacement machine; and wherein said primary counterweight and said secondary counterweight being both positioned adjacent one another between said scroll pair and said bearing means.

6. The scroll-type displacement machine according to claim 5 wherein said primary counterweight and said secondary counterweight are combined into a single module affixed onto the output end of said drive shaft..

7. The scroll-type displacement machine according to claim 6 wherein said eccentric drive bearing means is further incorporated into said single module.

8. The scroll-type displacement machine according to claim 5 wherein said scroll-type displacement machine is configured for use as a compressor.

9. The scroll-type displacement machine according to claim 5 wherein said scroll-type displacement machine is adapted for use as an expander.

10. The scroll-type displacement machine according to claim 5 wherein said scroll-type displacement machine is adapted for use as a hydraulic pump.

11. The scroll-type displacement machine according to claim 5 wherein said scroll-type displacement machine is adapted for use as a fluid-driven motor.

12. A scroll-type displacement machine comprising:

a scroll pair, including a fixed scroll and an orbiting scroll;

rotary drive means including a housing, a drive shaft having an end portion projecting from the housing of the rotary drive means, and bearing means supporting said drive shaft in respect to said housing and permitting rotational motion of said drive shaft;

a frame supporting said scroll pair and holding said fixed scroll in a predetermined position and permitting orbiting motion of said orbiting scroll with respect to said fixed scroll;

said rotary drive means being configured to be affixed onto said frame, and including means to provide axial and radial alignment of said drive shaft with respect to said scroll pair;

a widget drive shaft member affixed onto the end portion of said drive shaft;

eccentric drive bearing means affixed onto said widget drive shaft member for effecting orbiting motion of said orbiting scroll, and adapted for driving said orbiting scroll in a generally circular orbit with respect to said fixed scroll;

a primary counterweight affixed onto said widget drive shaft member;

a secondary counterweight positioned axially apart from said primary counterweight on said widget drive shaft member;

said primary counterweight and said secondary counterweight being adapted to provide static and dynamic rotational balance for said scroll-type displacement machine; and said primary counterweight and said secondary counterweight both being positioned between said scroll pair and the bearing means of said rotary drive means.

13. The scroll-type displacement machine according to claim 12, wherein said widget drive shaft member, said primary counterweight and said secondary counterweight are combined into a unitary module that is affixed onto the end of said drive shaft.

14. The scroll-type displacement machine according to claim 13 wherein said unitary module also incorporates said eccentric drive bearing means.

15. The scroll-type displacement machine according to claim 12 wherein said machine is configured for use as a compressor.

16. The scroll-type displacement machine according to claim 12 wherein said machine is configured for use as a hydraulic pump.

17. A scroll-type displacement machine that comprises:

a scroll pair including a first scroll and a second scroll, said scrolls having spiral vanes that interfit with one another, and said first and second scrolls being arranged for orbital action about one another around an orbital axis;

said first scroll having a plurality of first flat surfaces in first planes that are parallel to said orbital axis, and said second scroll having a plurality of second flat surfaces arranged in second planes that are parallel to said orbital axis and perpendicular to said first planes;

an Oldham coupling formed to have pairs of first surfaces adapted for sliding engagement with the first flat surfaces of said first scroll and also to have second surfaces adapted for sliding engagement with the second flat surfaces of said second scroll, to allow said orbiting motion as between said first and second scrolls but to block relative rotational motion between said first and second scrolls; and wherein said Oldham coupling has a geometry divided by a lateral plane, which is perpendicular to said orbital axis, into four substantially identical generally arc-shaped segments with two of said four segments including the first flat surfaces for slidably engaging said first scroll and the remaining two of said four segments including the second flat surfaces for slidably engaging said second scroll, with successive ones of said segments being altenately at one or another of two different axial locations, respectively.

18. The scroll machine according to claim 17 wherein said generally arc-shaped segments each overlap adjacent ones of said arc-shaped segments at said lateral plane creating four pairs of overlap zones.

19. The scroll machine according to claim 18 wherein adjacent ones of said arc-shaped segments are joined together at said overlap zones.

20. The scroll machine according to claim 19 wherein adjacent ones of said arc-shaped segments are stacked upon one another at said overlap zones.

21. The scroll machine according to claim 18 wherein said arc-shaped segments are joined together through four respective posts extending between said four overlap zones.

22. A scroll-type displacement machine that comprises:

a scroll pair including a fixed scroll and an orbiting scroll;

a compressor frame;

a drive shaft mounted on at least one bearing and adapted for rotational movement about a drive axis;

a drive assembly attached to one end of said drive shaft to drive said orbiting scroll through a circular orbital path relative to an axis of said fixed scroll; with the drive assembly including counterweight means adapted to provide dynamic mass balancing of said orbiting scroll; and a motor unit removably attached to said frame, said motor unit comprising a stator portion, a rotor portion, a motor housing from which projects the one end of said drive shaft and having at least one bearing supporting said drive shaft.

23. The scroll machine according to claim 22 wherein said counterweight means and said drive assembly are incorporated into a unitary drive module that is affixed onto said one end of said shaft.

24. The scroll machine according to claim 22 wherein said motor unit is an available off-the-shelf motor package, and said frame is configured to accept said motor unit.

25. A high-side scroll-type displacement machine adapted to move a working fluid between a low-pressure environment and a high-pressure environment, the scroll-type displacement machine comprising:

a main housing having a proximal opening situated at a proximal portion thereof;

a scroll pair comprising an orbiting scroll and a fixed scroll, said fixed and orbiting scrolls having respective spiral vanes which interfit with one another;

Oldham ring means coupled to said fixed and orbiting scrolls for constraining said orbiting scroll against rotation but permitting said orbiting scroll to enjoy orbital motion about an axis of said fixed scroll;

a rotary drive shaft having a rotary axis and adapted for rotary motion within said housing about said rotary axis;

eccentric drive means positioned on said drive shaft adjacent said scroll pair and operatively coupled to said orbiting scroll such that rotation of said drive shaft corresponds with orbiting motion of said orbiting scroll;

said main housing enclosing at least said eccentric drive bearing means, at least said orbiting scroll, and at least a portion of said rotary shaft;

said fixed scroll being adapted to seat into the proximal opening of said main housing so as to define a proximal end bulkhead for sealably closing off said main housing; with said fixed scroll having the spiral vane thereof facing into an interior of said main housing in interfitting relation with said orbiting scroll, and having an opposite face facing outward from said main housing; a low-pressure port being located on said opposite face of the fixed scroll and communicating with a radially outer portion of the spiral vane thereof and communicating with said low-pressure environment outside said main housing;

said scroll pair having a high-pressure port; and internal routing coupled to the high-pressure port and communicating first between said high-pressure port and said eccentric drive means and resulting in said high-pressure environment being located in the interior of said housing.

26. The high-side scroll-type displacement machine according to claim 25, wherein said high-pressure port is disposed in said orbiting scroll at a radially central portion of said spiral vane thereof.

27. The high-side scroll-type displacement machine according to claim 25, wherein said fixed scroll has an annular surface of a predetermined external diameter, and said proximal opening of said main housing comprises a circular bore that substantially matches said predetermined external diameter of said fixed scroll.

28. The high-side scroll-type displacement machine according to claim 27, wherein said annular surface of predetermined external diameter, and said circular bore engage sealingly to contain said high-pressure environment within said housing.

29. The high-side scroll-type displacement machine according to claim 27 wherein said circular bore has an annular retaining ring groove therein, and a spring-action retaining ring seats in said annular retaining ring groove against said opposite face of the fixed scroll to maintain the fixed scroll in place in said circular bore.

* * * * *